US005360711A

United States Patent [19]

Negoro et al.

[11] Patent Number: 5,360,711

[45] Date of Patent: Nov. 1, 1994

[54] SILVER HALIDE COLOR PHOTOGRAPHIC MATERIAL

[75] Inventors: Masayuki Negoro; Masakazu Morigaki, both of Kanagawa, Japan

[73] Assignee: Fuji Photo Film Co., Ltd., Kanagawa, Japan

[21] Appl. No.: 62,542

[22] Filed: May 18, 1993

[30] Foreign Application Priority Data

May 19, 1992 [JP] Japan ..... 4-150121

[51] Int. Cl.[5] ..... G03C 1/34; G03C 7/388

[52] U.S. Cl. ..... 430/551; 430/546

[58] Field of Search ..... 430/551, 613, 546

[56] References Cited

U.S. PATENT DOCUMENTS

| | | | |
|---|---|---|---|
| 4,540,658 | 9/1985 | Sasaki et al. | 430/551 |
| 4,704,350 | 11/1987 | Morigaki et al. | 430/546 |
| 4,880,733 | 11/1989 | Kaneko | 430/551 |
| 5,082,766 | 1/1992 | Nishijima et al. | 430/551 |
| 5,104,781 | 4/1992 | Seto et al. | 430/546 |
| 5,232,821 | 8/1993 | Merkel et al. | 430/551 |

FOREIGN PATENT DOCUMENTS

| | | |
|---|---|---|
| 0178794 | 4/1986 | European Pat. Off. . |
| 0310551 | 9/1988 | European Pat. Off. . |
| 0310552 | 9/1988 | European Pat. Off. . |
| 0510576 | 10/1992 | European Pat. Off. . |
| 62-103642 | 5/1987 | Japan . |
| 63-43146 | 2/1988 | Japan . |
| 63-149644 | 6/1988 | Japan . |
| 1410846 | 10/1975 | United Kingdom . |

*Primary Examiner*—Lee C. Wright
*Attorney, Agent, or Firm*—Birch, Stewart, Kolasch & Birch

[57] ABSTRACT

A sliver halide color photographic material comprise-ing a support having at least one layer containing at least one a compound of the formula (I), (II) or (III).

(I)

(II)

(III)

n=0, 1, or 2.

19 Claims, No Drawings

SILVER HALIDE COLOR PHOTOGRAPHIC MATERIAL

FIELD OF THE INVENTION

This invention relates to a silver halide color photographic material (hereinafter referred to simply as light-sensitive material), and more particularly to a light-sensitive material which gives a finished dye image by processing, said dye image being prevented from being faded or discolored.

BACKGROUND OF THE INVENTION

Generally, light-sensitive materials have silver halide emulsion layers sensitive to the three primary colors of red, green and blue, respectively, and a dye image is reproduced by a method wherein three kinds of color formers (couplers) contained in emulsion layers are developed to form colors having a relation of complementary colors to the light to which the emulsion layers are sensitive. Namely, a dye image is reproduced by subtractive color photography. A dye image obtained by photographically processing the light-sensitive material comprises generally an azomethine dye or an indoaniline dye formed by the reaction of the oxidants of aromatic primary amine color developing agents with couplers. The thus-obtained photographic color image is not always stable against light, heat and moisture, and when the color image is exposed to light over a long period of time or stored under high temperature and humidity conditions, the dye image is faded or discolored, and the image quality thereof is deteriorated.

The fading or discoloration of the image is a serious problem in recording materials. To eliminate this problem, there have been proposed the development of couplers giving a dye image having high fastness, the use of anti-fading agents, and the use of ultraviolet light absorbers to prevent the image from being deteriorated by ultraviolet light.

Examples of the anti-fading agents conventionally known include hydroquinones, hindered phenols, catechols, gallic esters, aminophenols, hindered amines, chromanols, indenes and ethers or esters obtained by silylating, acylating or alkylating the phenolic hydroxyl group of these compounds and metal complexes.

Further, sulfides having a specific structure, sulfoxides, sulfur-containing heterocyclic compounds and tetrahydrothiopyran compounds having a specific structure are proposed in U.S. Pat. Nos.4,540,658, 4,880,733, 4,704,350 and 5,104,781, U.K. Patent 1,410,846, JP-A-63-43146 (the term "JP-A" as used herein means an "unexamined published Japanese patent application"), JP-A-63-149644, JP-A-62-103642, European Patent Laid-Open Nos. 178,794, 310,551 and 310,552.

These compounds have certainly an effect of preventing dye images from being faded or discolored. However, these compounds are insufficient to cope with the demand of customers which require a higher image quality, and an excellent effect demanded by color photograph can not be obtained so far.

SUMMARY OF THE INVENTION

An object of the present invention is to provide a light-sensitive material which gives a dye image having greatly improved fastness to light.

Another object of the present invention is to provide a light-sensitive material which has improved fastness without any adverse effect on color developability, hue or photographic characteristics.

Still another object of the present invention is to provide a light-sensitive material which does not suffer from a change in color balance by the fading of the three colors of yellow, magenta and cyan colors.

Other object of the present invention is to provide a light-sensitive material which avoids formation of a yellow stain and a colored stain on white areas due to light, heat and temperature.

Still a further object of the present invention is to provide a light-sensitive material which is excellent in spectral absorption characteristics, has good color reproducibility, and gives a dye image having greatly improved fastness.

The present inventors have eagerly made studies and found that compounds represented by the following general formula (I), (II) or (III) have an excellent effect on preventing the fading of dye images.

Accordingly, the above-described objects of the present invention have been achieved by providing a silver halide color photographic material comprising a support having thereon at least one layer containing at least one compound represented by the following general formula (I), (II) or (III)

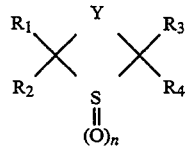

(I)

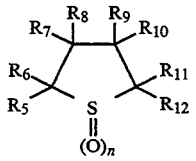

(II)

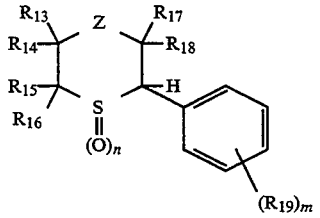

(III)

wherein $R_1$, $R_2$, $R_3$, $R_4$, $R_5$, $R_6$, $R_{11}$ and $R_{12}$ may be the same or different and each represents a hydrogen atom, an alkyl group, an aryl group or a heterocyclic group; Y represents a group represented by following general formula

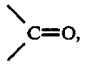

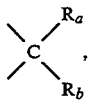

or

-continued

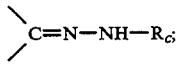

$R_a$, $R_b$, $R_7$, $R_8$, $R_9$, $R_{10}$, $R_{13}$, $R_{14}$, $R_{15}$, $R_{16}$, $R_{17}$ and $R_{18}$ may be the same or different and each represents a hydrogen atom or a substituent group, or $R_a$ and $R_b$ may be combined together to form a five-membered to seven-membered ring; $R_c$ represents an acyl group; $R_{19}$ represents a substituent group; Z represents —S—, —SO—, —$SO_2$—, —O— or —N($R_{20}$)—; $R_{20}$ has the same meaning as $R_{13}$; n represents 0 or an integer of 1 to 2; m represents 0 or an integer of 1 to 5; when m is 2 to 5, two or more $R_{19}$ groups may be the same or different.

DETAILED DESCRIPTION OF THE INVENTION

Now, the present invention will be illustrated in more detail below.

The term "substituent group" as used herein refers to an alkyl group, an alkenyl group, an alkynyl group, an aryl group, a heterocyclic group, a halogen atom, a cyano group, a nitro group, a hydroxyl group, an alkoxy group, an aryloxy group, an alkylthio group, an arylthio group, an acyloxy group , a sulfonyloxy group, an unsubstituted amino group, an alkylamino group, an arylamino group, an acylamino group, a sulfonamido group, an oxycarbonylamino group, an oxysulfonylamino group, a ureido group, an acyl group, an oxycarbonyl group, a carbamoyl group, a sulfonyl group, a sulfinyl group, an oxysulfonyl group or a sulfamoyl group, unless otherwise stated. Of these, the acyloxy group includes an alkyl, aryl or heterocyclic acyloxy group, and similarly, the sulfonyloxy, acylamino, sulfonamido, oxycarbonylamino, oxysulfonylamino, ureido, acyl, oxycarbonyl, sulfonyl, sulfinyl and oxysulfonyl groups include alkyl, aryl or heterocyclic group-containing ones, respectively. These groups may be optionally substituted by one or more of organic groups capable of bonding through a carbon atom, an oxygen atom, a nitrogen atom or a sulfur atom or halogen atoms, so long as these groups can be substituted.

More specifically, examples of the substituent group include an alkyl group having 1 to 60 carbon atoms, preferably 1 to 30 carbon atoms (e.g., methyl, n-propyl, sec-butyl, n-dodecyl, n-octadodecyl, benzyl, cyclopropyl, cyclohexyl), an alkenyl group having 2 to 60 carbon atoms, preferably 2 to 30 carbon atoms (e.g., methylmethylene, ethylmethylene, isopropylmethylene), an alkynyl group having 2 to 60 carbon atoms, preferably 2 to 30 carbon atoms (e.g., methylmethine, isopropylmethine, phenylmethine), an aryl group having 6 to 60 carbon atoms, preferably 6 to 35 carbon atoms (e.g., phenyl, p-hexadecyloxyphenyl, 2,5-di-tert-amylphenyl, naphthyl), a saturated or unsaturated, optionally fused ring heterocyclic group having at least one hetero atom selected from the group consisting at O, S and N, and having 1 to 60 carbon atoms, preferably 1 to 30 carbon atoms (e.g., 2-furyl, 2-thienyl, 2-pyrimidinyl, 2-benzothiazolyl), a halogen atom (e.g., chlorine atom, bromine atom), a cyano group, a nitro group, a hydroxyl group, an alkoxy group having 1 to 60 carbon atoms, preferably 1 to 30 carbon atoms (e.g., methoxy, ethoxy, 2-methoxyethoxy, 2-dodecylethoxy, 2-methanesulfonylethoxy, an aryloxy group having 6 to 60 carbon atoms, preferably 6 to 35 carbon atoms (e.g., phenoxy, 2-methylphenoxy, 4-t-butylphenoxy, 3-nitrophenoxy, 3-t-butyloxycarbamoylphenoxy), an alkylthio group having 1 to 60 carbon atoms, preferably 1 to 30 carbon atoms (e.g., methylthio, octylthio, tetradecylthio, 2-phenoxyethylthio, 3-phenoxypropylthio, 3-(4-t-butylphenoxy)propylthio), an arylthio group having 6 to 60 carbon atoms, preferably 6 to 35 carbon atoms (e.g., phenylthio, 2-butoxy-5-t-octylphenylthio, 3-pentadecylphenylthio, 2-carboxyphenylthio, 4-tetradecaneamidophenylthio), an acyloxy group having 2 to 60 carbon atoms, preferably 2 to 35 carbon atoms (e.g., acetoxy), a sulfonyloxy group (e.g., sulfonyldioxy), an amino group, an alkylamino group having 1 to 60 carbon atoms, preferably 1 to 30 carbon atoms (e.g., methylamino, butylamino, dodecylamino, diethylamino, methylbutylamino), an arylamino group having 6 to 60 carbon atoms, preferably 6 to 35 carbon atoms (e.g., phenylamino), an acylamino group having 1 to 60 carbon atoms, preferably 1 to 35 carbon atoms (e.g., acetylamino, propanoylamino, sec-butanoylamino, n-dodecanoylamino), a sulfonamido group having 1 to 60 carbon atoms, preferably 1 to 35 carbon atoms (e.g., methanesulfonamido, hexadecanesulfonamido, benzenesulfonamido, p-toluenesulfonamido, octadecanesulfonamido, 2-methoxy-5-t-butylbenzenesulfonamido), an oxycarbonylamino group having 2 to 60 carbon atoms, preferably 2 to 35 carbon atoms (e.g., methoxycarbonylamino), an oxysulfonylamino group having 1 to 60 carbon atoms, preferably 1 to 35 carbon atoms (e.g., ethoxysulfonylamino), a ureido group having 1 to 60 carbon atoms, preferably 1 to 30 carbon atoms (e.g., phenylureido, methylureido, N,N-dibutylureido), an acyl group having 2 to 60 carbon atoms, preferably 2 to 35 carbon atoms (e.g., acetyl, benzoyl, pivaloyl, cyclopropionyl, α-(2,4-di-tert-amylphenoxy)butyryl, myristoyl, stearoyl, naphthoyl, m-pentadecylbenzoyl, isonicotinoyl), an oxycarbonyl group having 2 to 60 carbon atoms, preferably 2 to 35 carbon atoms (e.g., methoxycarbonyl, dodecyloxycarbonyl), a carbamoyl group having 1 to 60 carbon atoms, preferably 1 to 35 carbon atoms (e.g., N-ethylcarbamoyl, N-benzylcarbamoyl, N,N-dibutylcarbamoyl, N-phenylcarbamoyl , N-hexadecylcarbamoyl), a sulfonyl group having 1 to 60 carbon atoms, preferably 1 to 35 carbon atoms (e.g., methanesulfonyl, octanesulfonyl, benzenesulfonyl, toluenesulfonyl), a sulfinyl group having 1 to 60 carbon atoms, preferably 1 to 35 carbon atoms (e.g., dodecanesulfinyl, 3-pentadecylphenylsulfinyl, 3-phenoxypropylsulfinyl), an oxysulfonyl group having 1 to 60 carbon atoms, preferably 1 to 35 carbon atoms (e.g., methoxysulfonyl) and a sulfamoyl group having 0 to 60 carbon atoms, preferably 0 to 30 carbon atoms (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl). These groups may be optionally further substituted by one or more of the substituent groups described above, unless otherwise stated.

The compounds of general formulas (I) and (II) according to the present invention will be illustrated below.

$R_1$, $R_2$, $R_3$ and $R_4$ in general formula (I) and $R_5$, $R_6$, $R_{11}$ and $R_{12}$ in general formula (II) may be the same or different, and each represents a hydrogen atom, an alkyl group having 1 to 60 carbon atoms, preferably 1 to 30 carbon atoms (e.g., methyl, n-propyl, sec-butyl, n-dodecyl, n-octadodecyl, benzyl, cyclopropyl, cyclohexyl), an aryl group having 6 to 60 carbon atoms, preferably 6 to 35 carbon atoms ( e.g., phenyl, p-hexadecyloxyphenyl, 2,5-di-tert-amylphenyl, naphthyl) or a saturated or unsaturated, optionally fused ring heterocyclic group having at least one hetero atom selected from the group consisting of O, S, and N, and having 1 to 60 carbon atoms, preferably 1 to 30 carbon atoms (e.g., furyl, 2-thienyl, 2-pyrimidinyl, 2-benzthiazolyl).

$R_a$ and $R_b$ in general formula (I) and $R_7$, $R_8$, $R_9$ and $R_{10}$ in general formula (II) may be the same or different, and each is preferably a hydrogen atom, a hydroxyl group, an acyloxy group having 2 to 60 carbon atoms, preferably 2 to 35 carbon atoms (e.g., acetyloxy, myristoyloxy, palmitoyloxy, α-(2,5-di-tert-amylphenoxy)-butyloxy), an alkyl group having 1 to 60 carbon atoms, preferably 1 to 30 carbon atoms (e.g., methyl, n-propyl, sec-butyl, n-dodecyl, n-octadodecyl, benzyl, cyclopropyl, cyclohexyl), an aryl group having 6 to 60 carbon atoms, preferably 6 to 35 carbon atoms (e.g., phenyl, p-hexadecyloxyphenyl, 2,5-di-tert-amylphenyl, naphthyl), an alkoxy group having 1 to 60 carbon atoms, preferably 1 to 30 carbon atoms (e.g. , methoxy, ethoxy, 2-methoxyethoxy, 2-dodecylethoxy, 2-methanesulfonylethoxy), an aryloxy group having 6 to 60 carbon atoms, preferably 6 to 35 carbon atoms (e.g., phenoxy, 2-methylphenoxy, 4-t-butylphenoxy, 3-nitrophenoxy, 3-t-butyloxycarbamoylphenoxy), an alkylthio group having 1 to 60 carbon atoms, preferably 1 to 30 carbon atoms (e.g., methylthio, octylthio, tetradecylthio, 2-phenoxyethylthio, 3-phenoxypropylthio, 3-(4-t-butylphenoxy)propylthio), an arylthio group having 6 to 60 carbon atoms, preferably 6 to 35 carbon atoms (e.g., phenylthio, 2-butoxy-5-t-octylphenylthio, 3-pentadecylphenylthio, 2-carboxyphenylthio, 4-tetradecaneamidophenylthio), an alkylamino group having 1 to 60 carbon atoms, preferably 1 to 30 carbon atoms (e.g., methylamino, butylamino, dodecylamino, diethylamino, methylbutylamino), an arylamino group having 6 to 60 carbon atoms, preferably 6 to 35 carbon atoms (e.g., phenylamino), a carbamoyl group having 1 to 60 carbon atoms, preferably 1 to 35 carbon atoms (e.g., N-ethylcarbamoyl, N-benzylcarbamoyl, N,N-dibutylcarbamoyl, N-phenylcarbamoyl, N-hexadecylcarbamoyl), a sulfonamido group having 1 to 60 carbon atoms, preferably 1 to 35 carbon atoms (e.g., methanesulfonamido, hexadecanesulfonamido, benzenesulfonamido, p-toluenesulfonamido, octadecanesulfonamido, 2-methoxy-5-t-butylbenzenesulfonamido) or an acyl group having 2 to 60 carbon atoms, preferably 2 to 35 carbon atoms (e.g., acetyl, benzoyl, pivaloyl, cyclopropionyl, α-(2,4-di-tert-amylphenoxy)butyryl, myristoyl, stearoyl, naphthoyl, m-pentadecylbenzoyl, isonicotinoyl). $R_a$ and $R_b$ may be combined together to form a five-membered to seven-combined membered ring.

More preferably, $R_a$ and $R_b$ are each a hydrogen atom, an acyloxy group or an alkoxy group, and $R_7$, $R_8$, $R_9$ and $R_{10}$ are each a hydrogen atom, an acyloxy group, an alkyl group, an aryl group, an alkylthio group or an alkoxy group.

$R_c$ represents an acyl group having 2 to 60 carbon atoms, preferably 2 to 35 carbon atoms (e.g., acetyl, benzoyl, pivaloyl, cyclopropionyl, α-(2,4-di-tert-amylphenoxy)butyryl, myristoyl, stearoyl, naphthoyl, m-pentadecylbenzoyl, isonicotinoyl).

The compounds of general formula (I) where one of $R_1$ and $R_2$ is an aryl group and the other is a hydrogen atom, or where one of $R_3$ and $R_4$ is an aryl group and the other is a hydrogen atom, are preferred. Among the compounds of general formula (I), compounds represented by the following general formula (I-a) are more preferred.

(I-a)

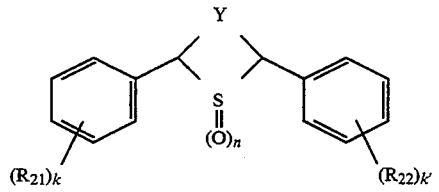

wherein n and Y are as defined in general formula (I); $R_{21}$ and $R_{22}$ may be the same or different and each represents a substituent group; k and k' each represents 0 or an integer of 1 to 5; when k and k' are each 2 or greater, two or more $R_{21}$ and $R_{22}$ groups may be the same or different; or when two or more $R_{21}$ and $R_{22}$ groups exist, the $R_{21}$ or $R_{22}$ groups at the ortho-position relative to each other may be combined together to form a five-membered to seven-membered ring.

Preferably, $R_{21}$ and $R_{22}$ are each an alkyl group, an aryl group, a saturated or unsaturated, optionally fused ring heterocyclic group, an alkoxy group, an aryloxy group, an alkylthio group, an arylthio group, an alkoxycarbonyl group, a carbamoyl group or an acyl group. More preferably, $R_{21}$ and $R_{22}$ are each an alkyl group, an aryl group, a heterocyclic group, an alkylthio group or an arylthio group.

Preferably, Y in formula (I) represents a group of the following general formula:

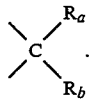

In general formulas (I) and (II), n is preferably 0 or 2, particularly preferably 0.

The compounds of general formula (II) where one of $R_5$ and $R_6$ is an aryl group and the other is a hydrogen atom or where one of $R_{11}$ and $R_{12}$ is an aryl group and the other is a hydrogen atom, are preferred. Among the compounds of general formula (II), compounds represented by the following general formula (II-a) are more preferred.

(II-a)

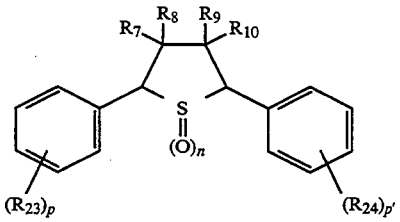

In general formula (II-a), $R_7$, $R_8$, $R_9$, R10 and n are the same as defined in general formula (II); $R_{23}$ and $R_{24}$ have the same meaning as $R_{21}$ and $R_{22}$ in general formula (I-a); and p and p' have the same meaning as k in general formula (I-a).

The compounds of general formula (III) will be illustrated in more detail below.

In general formula (III), $R_{13}$, $R_{14}$, $R_{15}$, $R_{16}$, $R_{17}$ and $R_{18}$ may be the same or different, and each is preferably a hydrogen atom, an alkyl group (e.g., methyl, n-propyl, sec-butyl, n-dodecyl, n-octadodecyl, benzyl, cyclopropyl, cyclohexyl ), an alkenyl group (e.g., methylmethylene, ethylmethylene, isopropylmethylene), an alkynyl group (e.g., methylmethine, isopropylmethine, phenylmethine), an aryl group (e.g., phenyl, p-hexadecyloxyphenyl, 2,5-di-tert-amylphenyl, naphthyl), a saturated or unsaturated, optionally fused ring heterocyclic group (e.g., 2-furyl, 2-thienyl, 2-pyrimidinyl, 2-benzothiazolyl), a halogen atom (e.g., chlorine atom, bromine atom), a cyano group, a nitro group, a hydroxy group, an alkoxy group (e.g., methoxy, ethoxy, 2-methoxyethoxy, 2-dodecylethoxy, 2-methanesulfonylethoxy), an aryloxy group (e.g., phenoxy, 2-methylphenoxy, 4-t-butylphenoxy, 3-nitrophenoxy, 3-t-butyloxycarbamoylphenoxy), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-octylphenylthio, 3-pentadecylphenylthio, 3-carboxyphenylthio, 4-tetradecaneamidophenylthio), an acyloxy group (e.g., acetoxy), a sulfonyloxy group (e.g., sulfonyldioxy), an unsubstituted amino group, an alkylamino group (e.g., methylamino, butylamino, dodecylamino, diethylamino, methylbutylamino), an arylamino group (e.g., phenylamino), an acylamino group (e.g., acetylamino, propanoylamino, sec-butanoylamino, n-dodecanoylamino), a sulfonamido group (e.g., methanesulfonamido, hexadecanesulfonamido, benzenesulfonamido, p-toluenesulfonamido, octadecanesulfonamido, 2-methoxy-5-t-butylbenzenesulfonamido), an oxycarbonylamino group (e.g., methoxycarbonylamino), an oxysulfonylamino group (e.g., ethoxysulfonylamino), a ureido group (e.g., phenylureido, methylureido, N,N-dibutylureido), an acyl group (e.g., acetyl, benzoyl, pivaloyl, cyclopropionyl, α-(2,4-di-tert-amylphenoxy)butyryl, myristoyl, stearoyl, naphthoyl, m-pentadecylbenzoyl, isonicotinoyl), an oxycarbonyl group (e.g., methoxycarbonyl, dodecyloxycarbonyl), a carbamoyl group (e.g., N-ethylcarbamoyl, N-benzylcarbamoyl, N,N-dibutylcarbamoyl, N-phenylcarbamoyl, N-hexadecylcarbamoyl), a sulfonyl group (e.g., methanesulfonyl, octanesulfonyl, benzenesulfonyl, toluenesulfonyl), a sulfinyl group (e.g., dodecanesulfinyl, 3-pentadecylphenylsulfinyl, 3-phenoxypropylsulfinyl), an oxysulfonyl group (e.g., methoxysulfonyl) or a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl).

Preferably, $R_{13}$, $R_{14}$, $R_{17}$ and $R_{18}$ are each a hydrogen atom, an alkyl group, an aryl group, an alkoxy group, an aryloxy group, an alkylthio group, a ureido group, an oxycarbonylamino group or an acylamino group. More preferred are a hydrogen atom, an alkyl group, an aryl group and an alkoxy group.

Preferably, $R_{15}$ and $R_{16}$ are each a hydrogen atom, a halogen atom, an alkyl group, an aryl group or an alkoxy group. More preferably, $R_{15}$ is an aryl group, and $R_{16}$ is hydrogen atom.

Examples of the substituent group represented by $R_{19}$ include those already described above in the definition of the substituent group for $R_{21}$ in general formula (I-a). Preferably, $R_{19}$ is an alkyl group, an aryl group, a heterocyclic group, an alkoxy group, an aryloxy group, an alkylthio group, an arylthio group, an alkoxycarbonyl group, a carbamoyl group or an acyl group. More preferably, $R_{19}$ is an alkyl group, an aryl group, a heterocyclic group, an alkylthio group or an arylthio group.

In general formula (III), n is an integer of 0 to 2, preferably 0 or 2, more preferably 0.

Preferably, Z is —S—, —SO—, —$SO_2$— or —O—.

More preferably, Z is —S— or —$SO_2$—.

Specific examples of the compounds of general formulas (I), (II) and (III) include, but are not limited to, the following compounds.

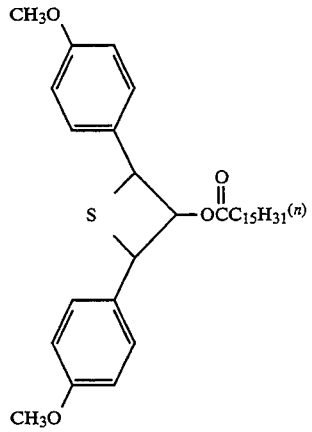

(I-a-1)

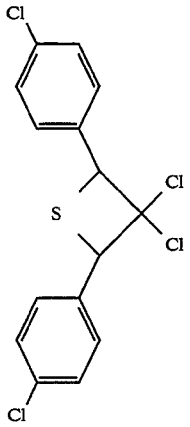

(I-a-2)

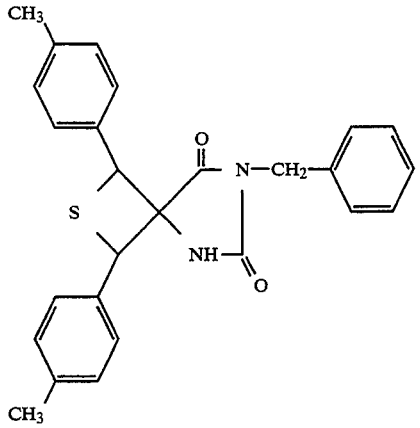

(I-a-3)

-continued
(I-a-4)
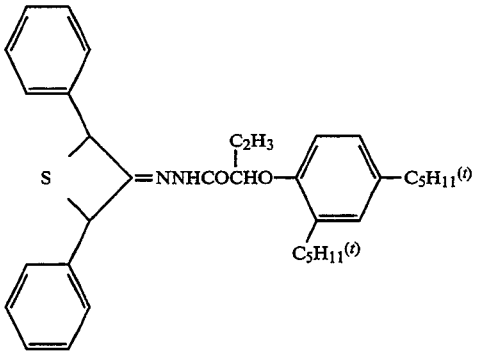
(I-a-5)
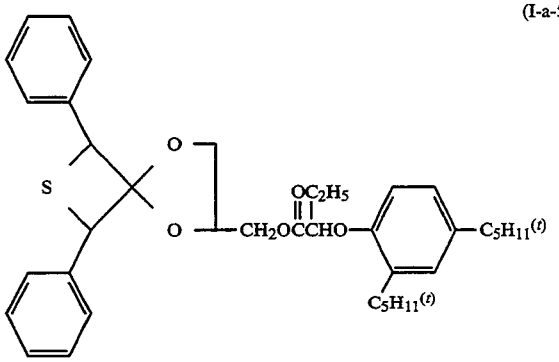
(I-a-6)
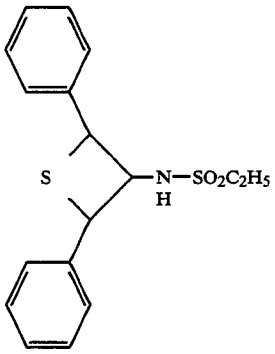
(I-a-7)
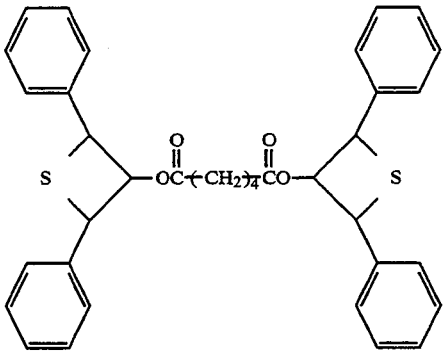
-continued
(I-a-8)
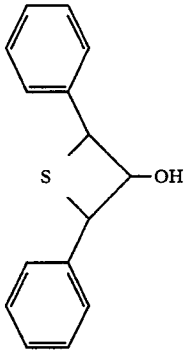
(I-a-9)
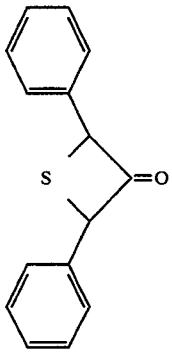
(I-a-10)
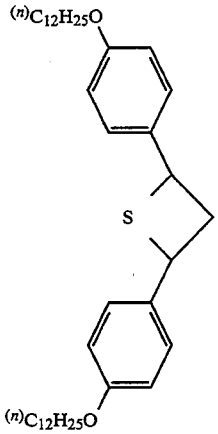
(I-a-11)
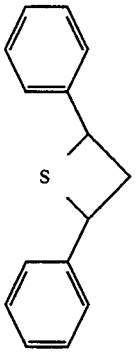

-continued
(I-a-12)
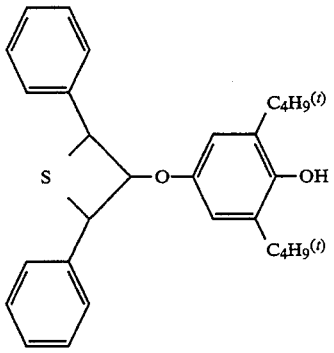
(I-a-13)
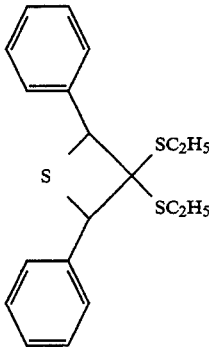
(I-a-14)
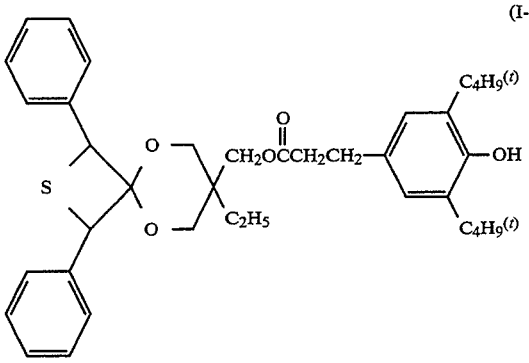
(I-a-15)
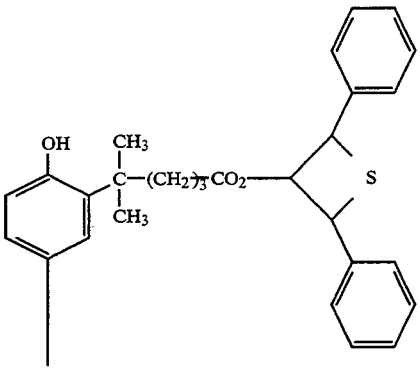
-continued
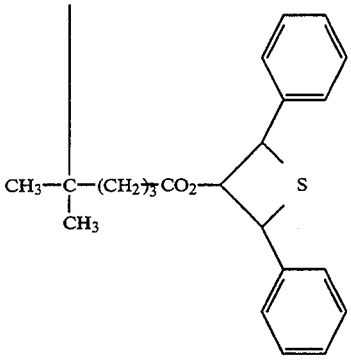
(I-a-16)
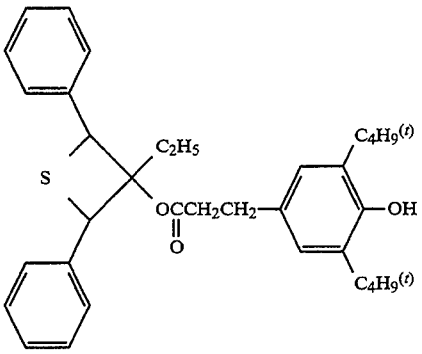
(I-a-17)
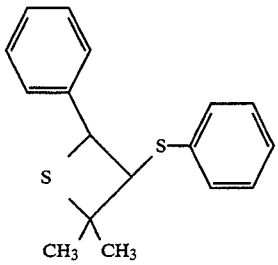
(I-a-18)
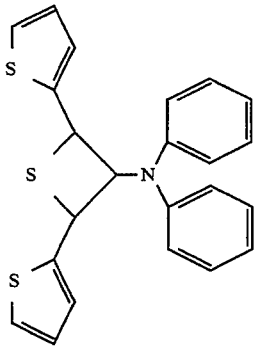
(I-a-19)
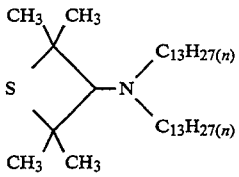

-continued
(I-a-20)
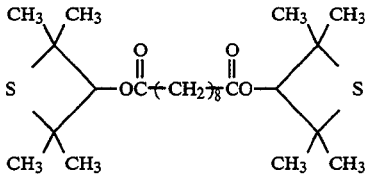
(I-a-21)
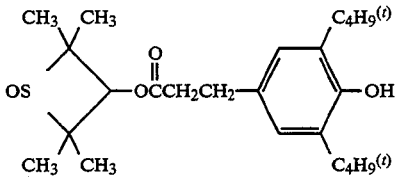
(I-a-22)
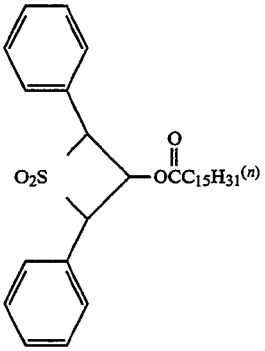
(I-a-23)
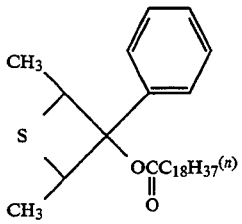
(II-a-1)
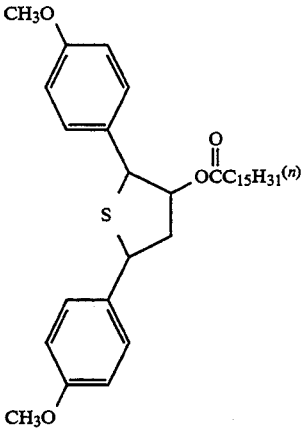
-continued
(II-a-2)
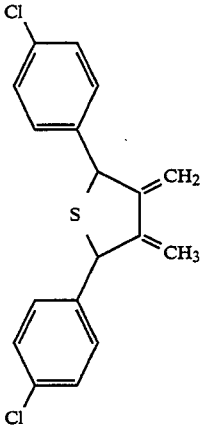
(II-a-3)
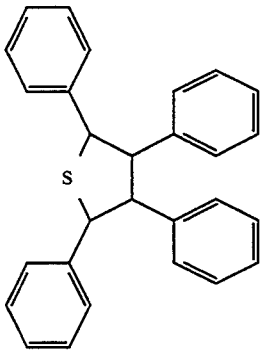
(II-a-4)
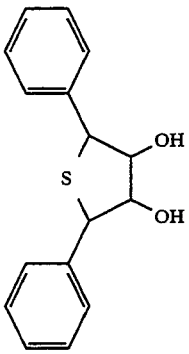
(II-a-5)
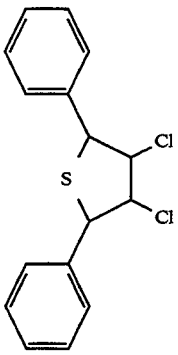

-continued
(II-a-6)
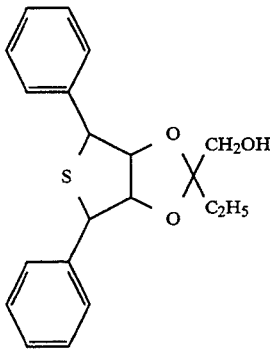
(II-a-7)
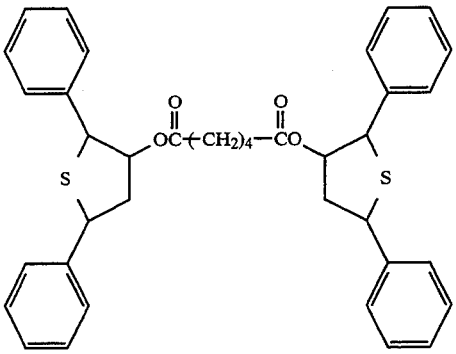
(II-a-8)
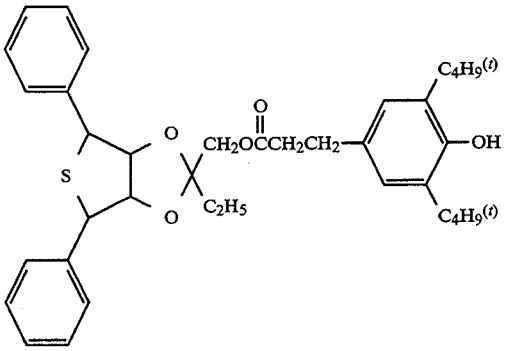
(II-a-9)
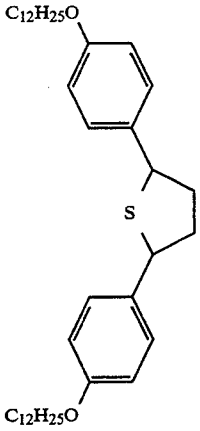
-continued
(II-a-10)
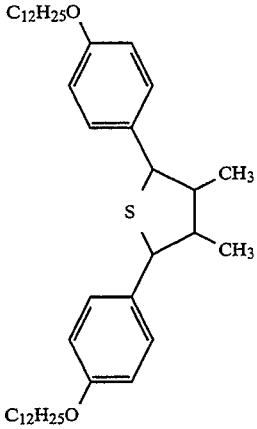
(II-a-11)
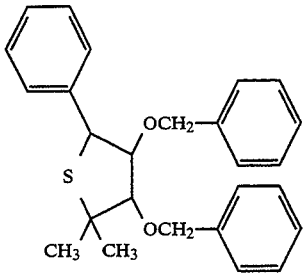
(II-a-12)
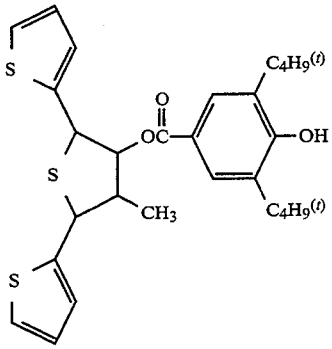
(II-a-13)
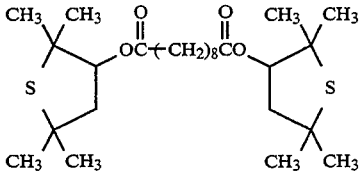
(II-a-14)
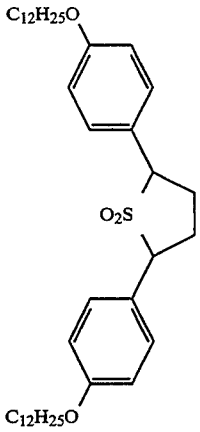

-continued
(II-a-15)
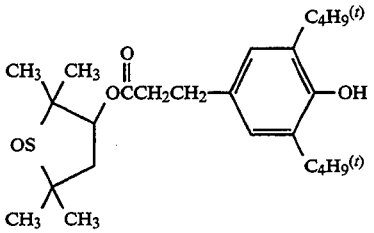
(II-a-16)
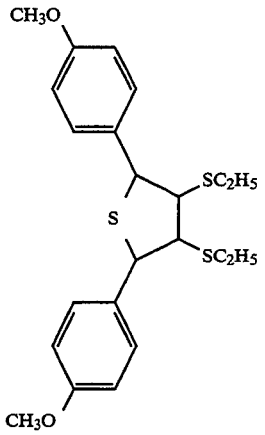
(II-a-17)
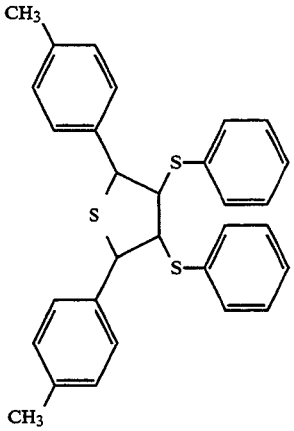
(II-a-18)
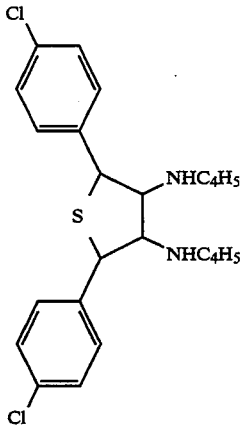
-continued
(II-a-19)
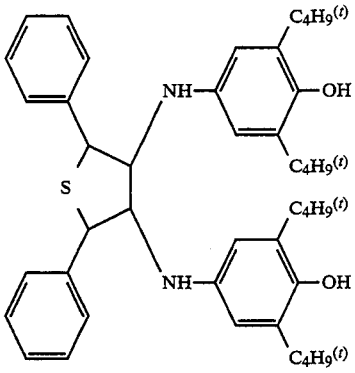
(II-a-20)
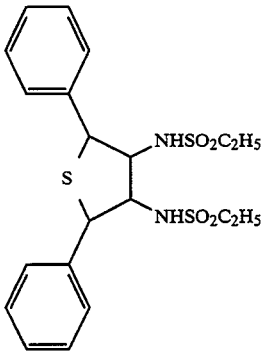
(III-1)
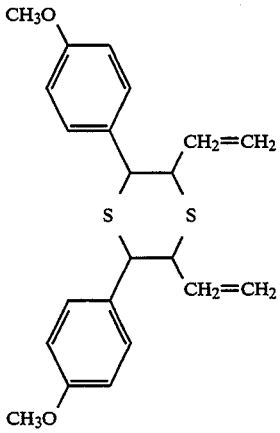
(III-2)
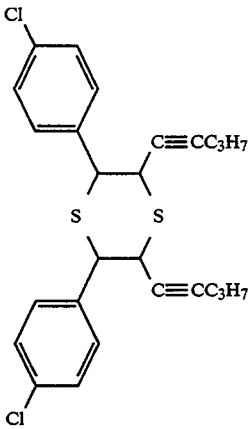

-continued
(III-3)
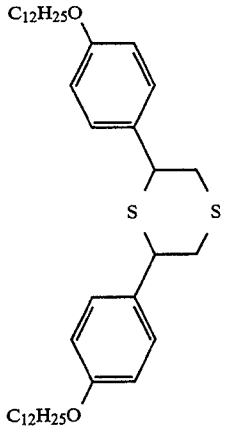
(III-4)
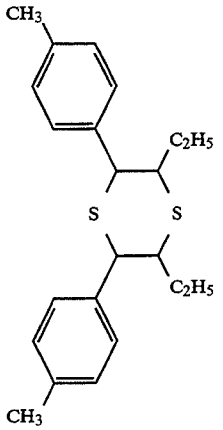
(III-5)
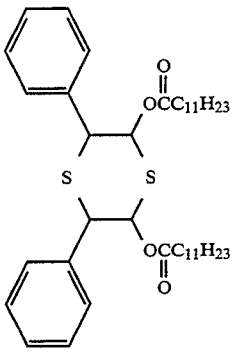
(III-6)
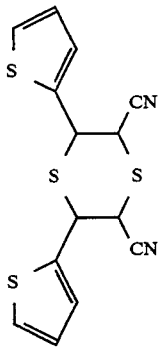
-continued
(III-7)
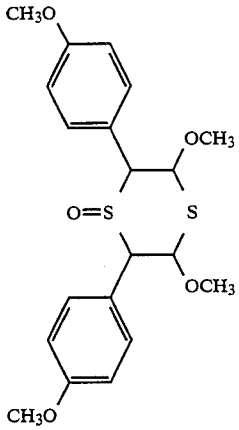
(III-8)
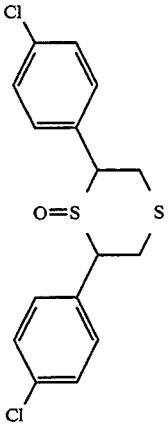
(III-9)
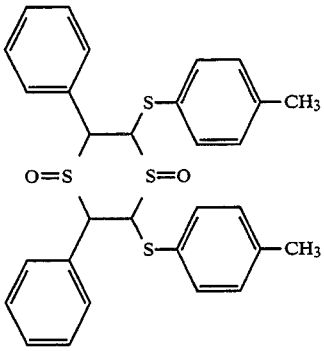
(III-10)
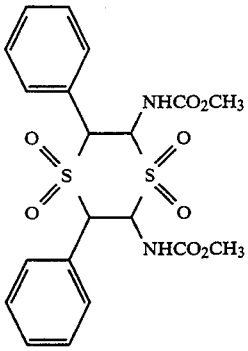

-continued
(III-11)
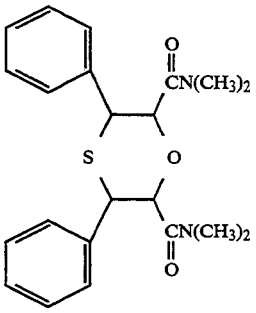
(III-12)
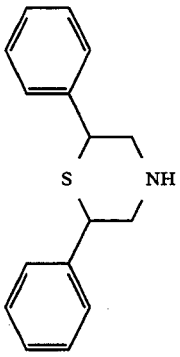
(III-13)
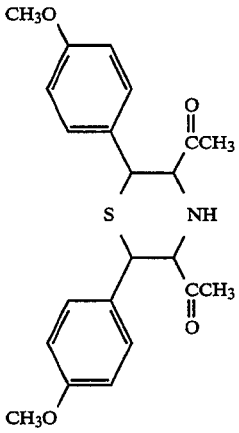
(III-14)
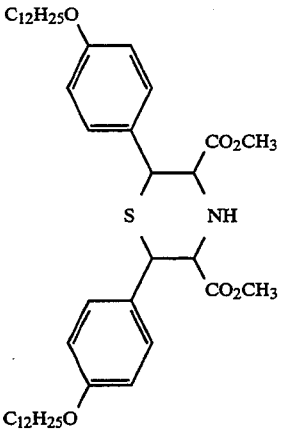
-continued
(III-15)
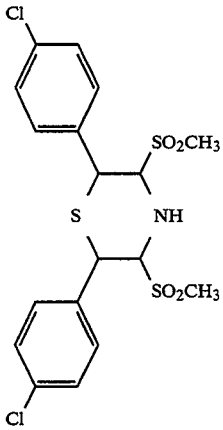
(III-16)
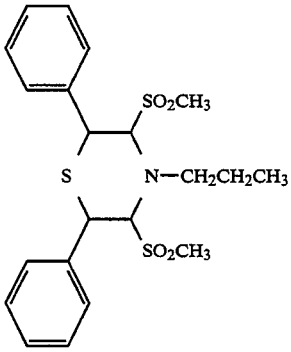
(III-17)
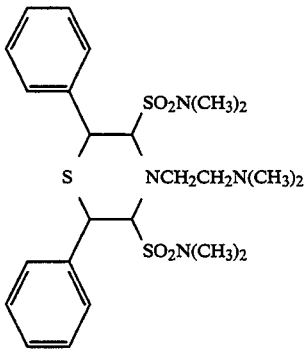
(III-18)
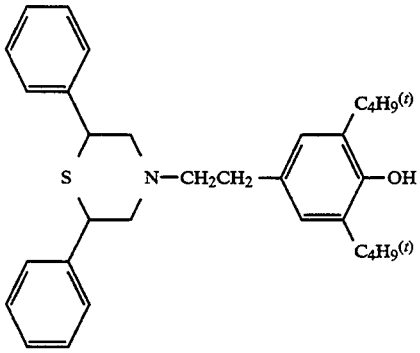

-continued
(III-19)
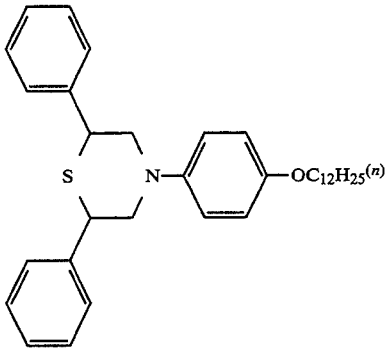
(III-20)
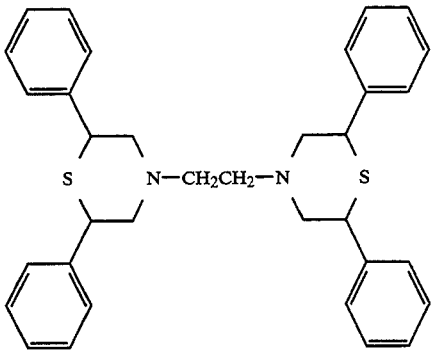
(III-21)
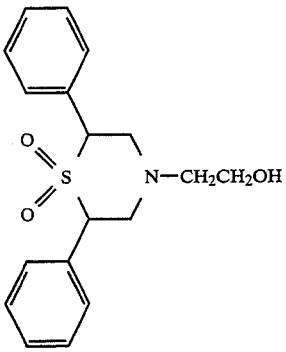
(III-22)
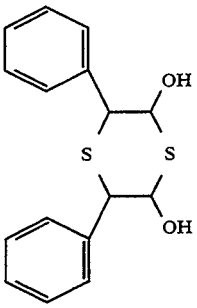
-continued
(III-23)
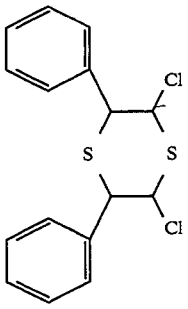
(III-24)
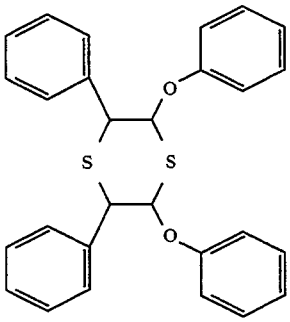
(III-25)
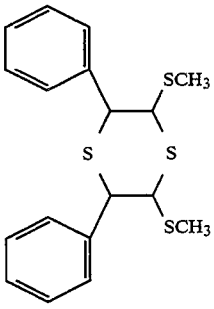
(III-26)
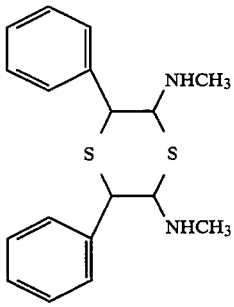
(III-27)
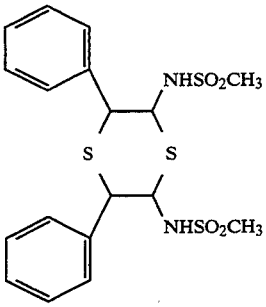

-continued (III-28)

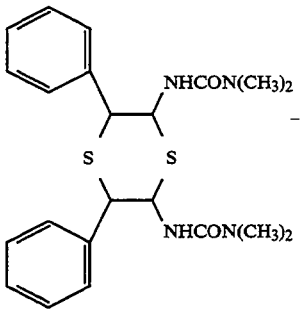

Preferred examples of the compounds of general formulas (I), (II) and (III) include (I-a-l), (I-a-7), (I-a-10), (I-a-12), (I-a-16), (II-a-1), (II-a-3), (II-a-7), (II-a-9), (II-a-10), (II-a-17), (III-3), (III-5) and (III-24).

The compounds of general formulas (I) to (III) can be easily synthesized, for example, by the methods described in *Chem. & Ind.*, 450 (1963), *J. Am. Chem. Soc.*, 93, 676 (1971), *J. AM. Chem. Soc.*, 59, 707 (1937) or *J. Pharm. Soc. Japan*, 77,359 (1957).

A synthesis example of a typical compound is illustrated below.

Synthesis of Compound (I-a-11)

To 50 ml of ethanol, there was added 6.0 g of sodium sulfite. An ethanol solution of 1,3-dichloro-1,3-diphenylpropane was slowly added dropwise thereto under reflux. After the resulting mixture was stirred for 6 hours, the reaction mixture (solution) was poured into water and extracted with 100 ml of ethyl acetate. The extract was washed with 50 ml of brine twice and dried over anhydrous magnesium sulfate. After magnesium sulfate was recovered by filtration, ethyl acetate was distilled off under reduced pressure to obtain a crystal. Mass spectrum, NMR spectrum and infrared absorption spectrum showed that the crystal was compound (I-a-11). Yield: 4.05 g (79%).

It is preferred that the compound of general formula (I), (II) or (III) according to the present invention is used in combination with a cyan coupler, a magenta coupler or a yellow coupler in the same layer, said couplers being coupled with the oxidation product of a primary aromatic amine color developing agent to form cyan color, magenta color and yellow color, respectively.

The couplers used in combination with the compounds may be a four equivalent type or a two equivalent type for silver ion. The couplers may be in the form of a polymer or an oligomer or may be used either alone or as a mixture of two or more of them.

The couplers which can be preferably used in the present invention will be illustrated below.

It is preferred from the viewpoint of the effect of the present invention that the compounds of general formula (I), (II) or (III) are used together with yellow couplers or cyan couplers, particularly together with yellow couplers. When the compounds of the present invention are used together with magenta couplers, the compounds have the excellent effect of improving fastness to light in the region of a further lower color density in comparison with conventional anti-fading agents such as diethers of hydroquinone derivatives, diethers of resorcin derivatives, diethers of catechol derivatives, tetraalkoxy-spirobiindane derivatives, aniline derivatives and ethers of aminophenol derivatives.

Examples of the yellow couplers include those described in U.S. Pat. Nos. 3,933,501, 4,022,620, 4,326,024, 4,401,752 and 4,248,961, JP-B-58-10739 (the term "JP-B" as used herein means an "examined Japanese patent publication"), U.K. Patents 1,425,020 and 1,476,760, U.S. Pat. Nos. 3,973,968, 4,314,023 and 4,511,649, European Patents 249,473A, 446,863A and 447,969, JP-A-63-23145, JP-A-63-123047, JP-A-1-250944, JP-A-1-213648, JP-A-2-139544 and Japanese Patent Application Nos. 3-179042 and 3-203545.

Yellow couplers which can be preferably used in the present invention are compounds represented by the following general formula (Y).

(Y)

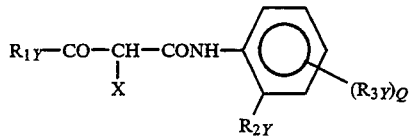

In general formula (Y), $R_{1y}$ represents a tertiary alkyl group, an aryl group or $—N(R_x)(R_y)$; $R_{2y}$ represents hydrogen atom, a halogen atom, an alkoxy group, an aryloxy group, an alkyl group or a dialkylamino group; $R_{3y}$ represents a group which can be attached to the benzene ring; X represents hydrogen atom or a group (eliminatable group) which is eliminated by the coupling reaction with the oxidant of an aromatic primary amine developing agent; Q represents 0 or an integer of 1 to 4 and when Q is 2 or greater, two or more $R_{3Y}$ groups may be the same or different; and $R_x$ and $R_y$ may be the same or different and each represents an alkyl group, an alkenyl group, an aryl group or a heterocyclic group, or $R_x$ and $R_y$ may be combined together to form a five-membered or six-membered ring which may be optionally substituted or fused together with an aromatic ring, an alicyclic ring or a heterocyclic ring.

Examples of the group represented by $R_{3Y}$ include a halogen atom, an alkyl group, an aryl group, an alkoxy group, an aryloxy group, an alkoxycarbonyl group, an aryloxycarbonyl group, a carboxamido group, a sulfonamido group, a carbamoyl group, a sulfamoyl group, a sulfonyl group, a sulfonylsulfamoyl group, a sulfonylcarbamoyl group, a ureido group, an acylcarbamoylamino group, an acylsulfamoylamino group, a sulfamoylamino group, an alkoxycarbonylamino group, an acylsulfamoyl group, an acylcarbamoyl group, a nitro group, a heterocyclic group, a cyano group, an acyl group, an acyloxy group, an alkylsulfonyloxy group and an arylsulfonyloxy group. Examples of the eliminatable group include a heterocyclic group attached to the coupling active site through a nitrogen atom, an aryloxy group, an arylthio group, an acyloxy group, an alkylsulfonyloxy group, a heterocyclic oxy group and a halogen atom.

In general formula (Y), $R_{1Y}$ is preferably a t-butyl group, a cyclopropyl group wherein the 1-position is substituted by an alkyl group, a phenyl group, a phenyl group substituted by one or more halogen atoms, an alkyl group and an alkoxy group, a dialkylamino group, an alkylarylamino group or an indolinyl group; $R_{2Y}$ is preferably a halogen atom, a trifluoromethyl group, an alkoxy group or an aryloxy group; $R_{3Y}$ is preferably a halogen atom, an alkoxy group, an alkoxycarbonyl group, a carboxamido group, a sulfonamido group, a carbamoyl group or a sulfamoyl group; X is preferably an aryloxy group or a five-membered to seven-membered ring which is attached to the coupling active site through nitrogen atom and may be a heterocyclic group containing further one or more atoms of N, S, O and P; Q is preferably an integer of 0 to 2.

The couplers of general formula (Y) may be in the form of a dimer or a higher polymer coupler wherein the substituent group $R_{1Y}$, X, $R_{2Y}$ or $R_{3Y}$ contains a mother nucleus or a main chain of a homopolymer or a copolymer having a non-color forming polymerized unit.

Examples of the couplers of general formula (Y) include the following compounds.

(Y-1)

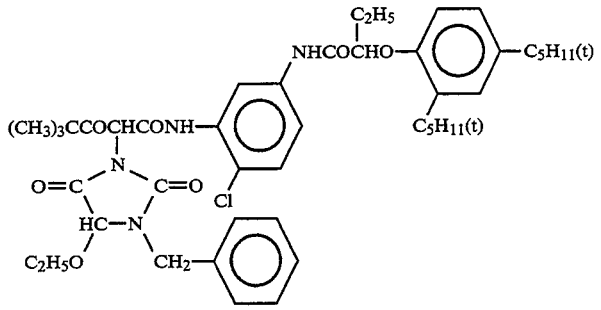

(Y-2)

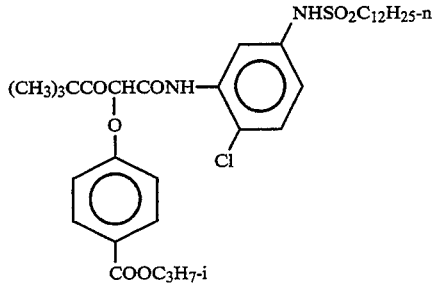

(Y-3)

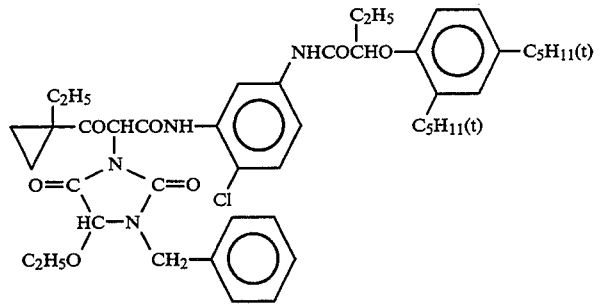

(Y-4)

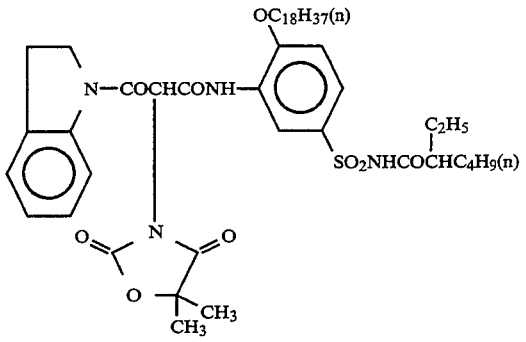

-continued (Y-5)

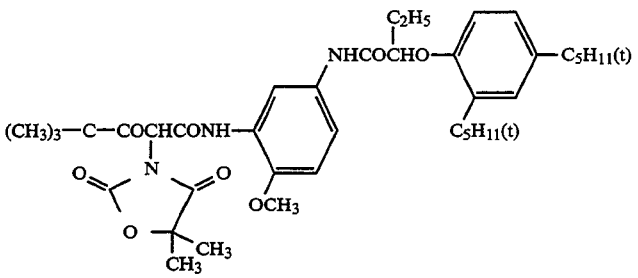

(Y-6)

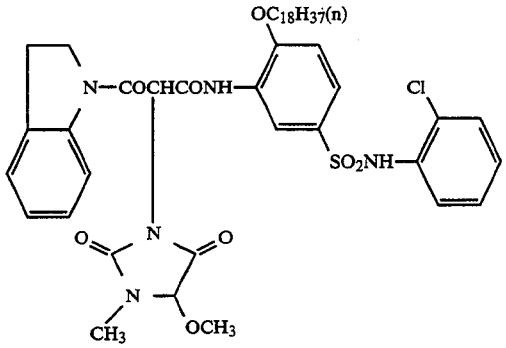

Preferred examples of the couplers of general formula (Y) include (Y-1), (Y-3) and (Y-4).

Examples of yellow couplers which can be used in addition to the above-described yellow couplers in the present invention and the synthesis methods of these yellow couplers are described in U.S. Pat. Nos. 3,227,554, 3,408,194, 3,894,875, 3,933,501, 3,973,968, 4,022,620, 4,057,432, 4,115,121, 4,203,768, 4,248,961, 4,266,019, 4,314,023, 4,327,175, 4,401,752, 4,404,274, 4,420,556, 4,711,837 and 4,729,944, European Patents 30,747A, 284,081A, 296,793A, 313,308A and 447,964, West German Patent 3,107,173C, JP-A-58-42044, JP-A-59-174839, JP-A-62-276547, JP-A-63-123047 and Japanese Patent Application Nos. 3-179042 and 3-203545.

Cyan couplers include phenol couplers and naphthol couplers. Examples of cyan couplers which can be preferably used in the present invention include those described in U.S. Pat. Nos. 4,052,212, 4,146,396, 4,228,233, 4,296,200, 2,269,929, 2,801,171, 2,772,162, 2,895,862, 3,772,002, 3,758,308, 4,334,011 and 4,327,173, West German Patent Laid-Open No. 3,329,729, European Patents 121,365A, 249,453A and 333,185A2, U.S. Pat. Nos. 3,446,622, 4,333,999, 4,775,616, 4,451,559, 4,427,767, 4,690,889, 4,254,212 and 4,296,199 and JP-A-1-42658. Further, there can be used azole couplers described in JP-A-64-553, JP-A-64-554, JP-A-64-555, JP-A-64-556 and Japanese Patent Application Nos. 3-280964 and 3-335916, imidazole couplers described in U.S. Pat. No. 4,818,672 and JP-A-2-33144 and cyclic active methylene type cyan couplers described in JP-A-64-32260.

Particularly preferred cyan couplers include couplers of general formulas (C-I) and (C-II) described in JP-A-2-139544 (left lower column of page 17 to left lower column of page 20).

Magenta couplers which can be preferably used in the present invention include 5-pyrazolone compounds and pyrazoloazole compounds. Examples of the magenta couplers which can be more preferably used in the present invention include those described in U.S. Pat. Nos. 4,310,619 and 4,351,897, European Patent 73,636, U.S. Pat. Nos. 3,061,432 and 3,725,067, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630 and (PCT) WO 88/04795.

Particularly preferred magenta couplers include pyrazoloazole magenta couplers of general formula (I) described in JP-A-2-139544 (right lower column of page 3 to right lower column of page 10) and 5-pyrazolone magenta couplers of general formula (M-1) described in JP-A-2-139544 (left lower column of page 17 to left upper column of page 21). Most preferred are the above-described pyrazoloazole magenta couplers.

Typical examples of the magenta couplers and cyan couplers which can be used in the present invention include the following compounds.

(M-1)

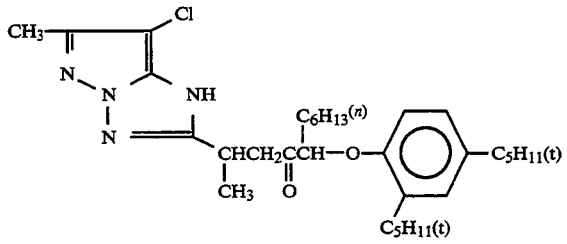

-continued
(M-2)
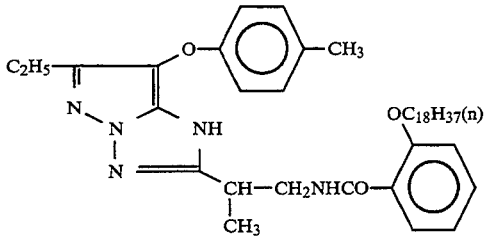
(M-3)
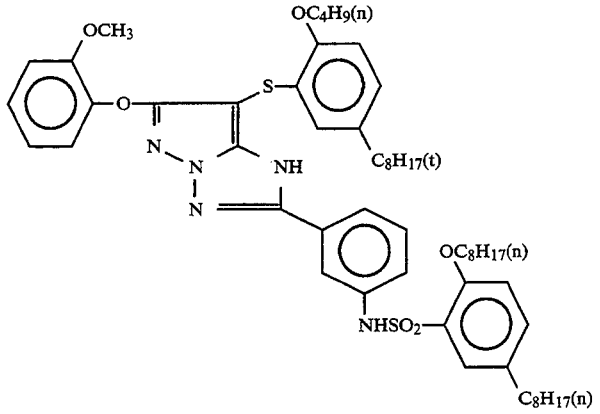
(M-4)
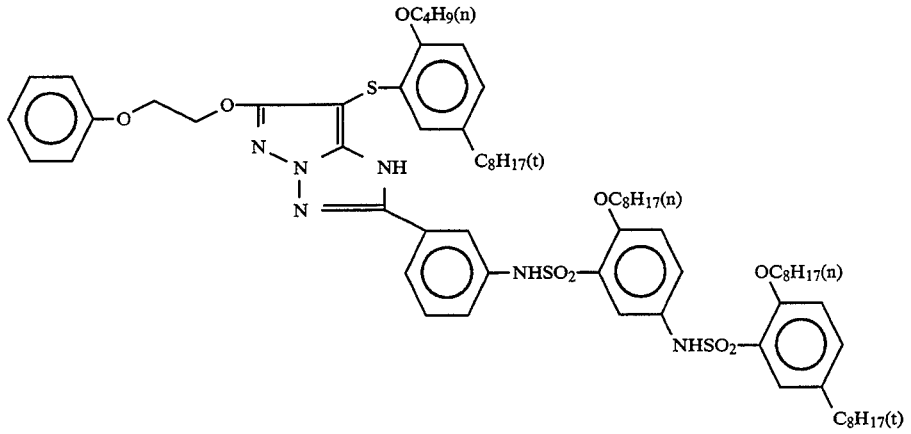
(M-5)
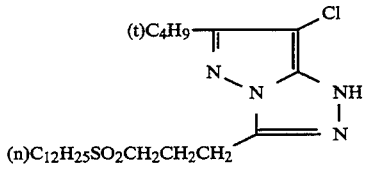
(M-6)
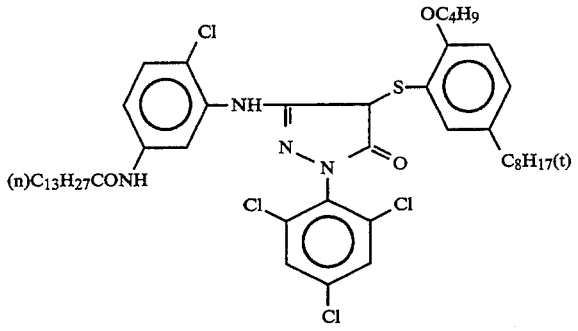

-continued
(M-7)
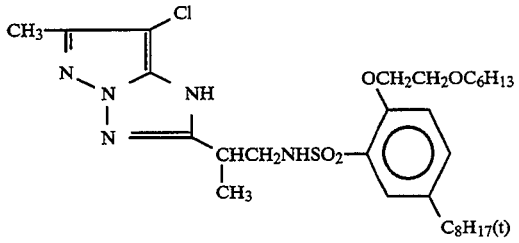
(M-8)
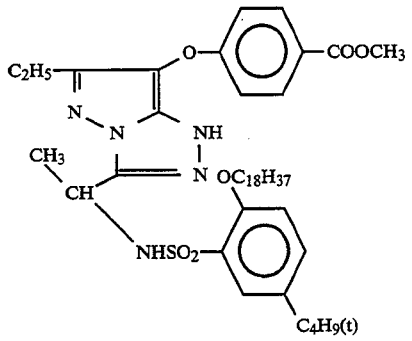
(C-1)
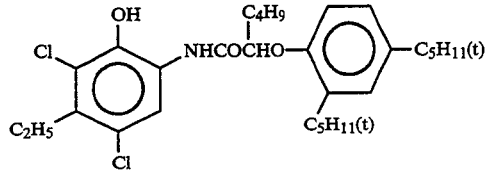
(C-2)
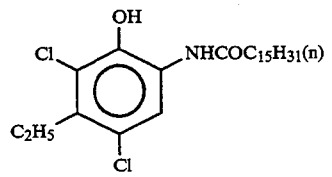
(C-3)
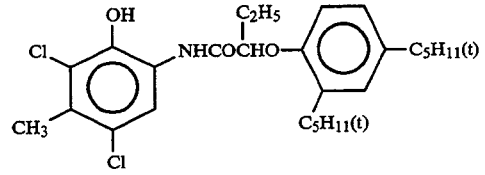
(C-4)
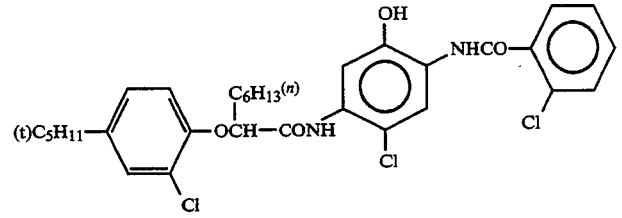
(C-5)
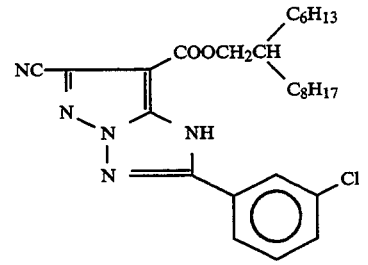

-continued (C-6)

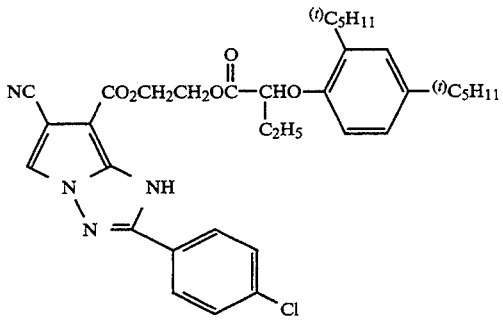

Preferred examples of the magenta couplers include (M-1), (M-5) and (M-8).

Preferred examples of the cyan couplers include (C-1), (C-5) and (c-6).

Couplers which release a photographically useful residue with coupling can be used in the present invention. Preferred examples of DIR coupler which release a restrainer include those described in patent specifications cited in *Research Disclosure* (RD) No. 17643, Item VII-F, JP-A-57-151944, JP-A-57-154234, JP-A-60-184248, JP-A-63-37346, U.S. Pat. Nos. 4,248,962 and 4,782,012.

Preferred examples of couplers which imagewise release a nucleating agent or a development accelerator during development include those described in U.K. Patents 2,097,140 and 2,131,188, JP-A-59-157638 and JP-A-59-170840.

Examples of other couplers which can be used in the light-sensitive materials of the present invention include competitive couplers described in U.S. Pat. No. 4,130,427; polyequivalent type couplers described in U.S. Pat. Nos. 4,284,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and JP-A-62-24252; couplers which release a dye whose color is restored after elimination as described in European Patent 173,302A; bleach-accelerating agent-releasing couplers described in RD No. 11449, RD No. 24241 and JP-A-61-201247; ligand-releasing couplers described in U.S. Pat. No. 4,553,477; leuco dye-releasing couplers described in JP-A-63-75747; and fluorescent dye-releasing couplers described in U.S. Pat. No. 4,774,181.

These couplers are generally used in an amount of 0.001 to 1 mol per mol of the light-sensitive silver halide in the present invention. Preferably, yellow couplers are used in amount of 0.01 to 0.5 mol, magenta couplers are used in an amount of 0.003 to 0.3 mol, and cyan couplers are used in an amount of 0.002 to 0.3 mol.

The amounts of the compounds of general formula (I), (II) or (III) according to the present invention vary depending on the types of couplers to be used, but are generally used in an amount of preferably 0.5 to 300 mol % more preferably 1 to 200 mol % most preferably 5 to 150 mol % based on the amount of the coupler used in the same layer.

The compounds of the present invention may be used together with conventional anti-fading agents. When the compounds of the present invention are used in combination with conventional anti-fading agents, the fading prevention effect can be further increased. If desired, the compounds of general formulas (I) to (III) may be used in combination of two or more of them.

Examples of organic anti-fading agents for cyan, magenta and/or yellow images include hydroquinones, 6-hydroxychromans, 5-hydroxycoumarans, spirochromans, p-alkoxyphenols, hindered phenols such as bisphenols gallic acid derivatives, methylenedioxybenzenes, aminophenols, hindered amines and ethers or ester derivatives obtained by silylating or alkylating the phenolic hydroxyl group of the above-described compounds. Further, metal complexes such as (bissalicylaldoximato)nickel complex and ( bis-N,N-dialkyldithiocarbamato)nickel complex can also be used.

Examples of the organic anti-fading agents include hydroquinones, described in U. S. Pat. Nos. 2,360,290, 2,418,613, 2,700,453, 2,701,197, 2,728,659, 2,732,300, 2,735,765, 3,982,944 and 4,430,425, U.K. Patent 1,363,921, U.S. Pat. Nos. 2,710,801 and 2,816,028; 6-hydroxychromans, 5-hydroxychromans, and spirochromans described U.S. Pat. Nos. 3,432,300, 3,573,050, 3,574,627, 3,698,909 and 3,764,337 and JP-A-52-152225; spiroindanes described in U.S. Pat. No. 4,360,589; p-alkoxyphenols described in U.S. Pat. No. 2,735,765, U.K. Patent 2,066,975, JP-A-59-10539 and JP-B-57-19765; hindered phenols described in U.S. Pat. Nos. 3,700,455 and 4,228,235, JP-A-52-72224 and JP-B-52-6623; gallic acid derivatives, described in U.S. Pat. No. 3,457,079, methylenedioxybenzenes described in U.S. Pat. No. 4,332,886; aminophenols described in JP-B-56-21144; hindered amines described in U.S. Pat. Nos. 3,336,135 and 4,268,593, U.K. Patents 1,326,889, 1,354,313 and 1,410,846, JP-B-51-1420, JP-A-58-114036, JP-A-59-53846 and JP-A-59-78344; and metal complexes described in U.S. Pat. Nos. 4,050,938 and 4,241,155 and U.K. Patent 2,027,731(A). These compounds are used in an amount of generally 5 to 100% by weight based on the amount of the corresponding coupler. These compounds are co-emulsified with the couplers and added to the light-sensitive layers.

The photographic materials of the present invention may contain hydroquinone derivatives, aminophenol derivatives, gallic acid derivatives and ascorbic acid derivatives as color fogging inhibitors (antifogging agents).

It is more effective to introduce ultraviolet light absorbers into the cyan color forming layer and both layers adjacent thereto to prevent the cyan dye image from being deteriorated by heat and particularly light.

Examples of the ultraviolet light absorbers include aryl group-substituted benzotriazole compounds described in U.S. Pat. No. 3,533,794; 4-thiazotidone compounds described in U.S. Pat. Nos. 3,314,794 and 3,352,681; benzophenone compounds described in JP- A-46-2784; silicic ester compounds described in U.S. Pat. Nos. 3,705,805 and 3,707,395; butadiene compounds described in U.S. Pat. No. 4,045,229; and benzoxazole compounds described in U.S. Pat. Nos. 3,406,070 and 4,271,307; and triazine compounds described in JP-A-46-3335. If desired, ultraviolet absorbing couplers (e.g., α-naphthol cyan color forming couplers) and ultraviolet light absorbing polymers may be used. These ultraviolet light absorbers may be mordanted in specific layers. Among them, the aryl group-substituted benzotriazole compounds are preferred.

The compounds of general formulas (I), (II) or (III) according to the present invention and the couplers can be introduced into the light-sensitive materials by various conventional dispersion methods. There are preferred oil-in-water dispersion methods wherein they are dissolved in a high-boiling organic solvent (optionally together with organic a low-boiling organic solvent), the resulting solution is emulsified and in dispersed an aqueous gelatin solution, and the resulting emulsified dispersion is added to a silver halide emulsion.

Examples of the high-boiling organic solvent which can be used in the oil-in-water dispersion methods are described in U.S. Pat. No. 2,322,027. The stages and effects of latex dispersion methods as a type of a polymer dispersion method and examples of impregnating latex are described in U.S. Pat. No. 4,199,363, West German Patent Laid-Open (OLS) Nos. 2,541,274 and 2,541,230, JP-B-53-41091 and European Patent Laid-Open No. 029104. A dispersion method using organic solvent-soluble polymers is described in (PCT) WO 88/00723.

Specific examples of the high-boiling organic solvent which can be used in the oil-in-water dispersion methods include phthalic esters (e.g., dibutyl phthalate, dioctyl phthalate, dicyclohexyl phthalate, di-2-ethylhexyl phthalate, decyl phthalate, bis(2,4-di-tert-amylphenyl) isophthalate, bis(1,1-diethylpropyl) phthalate), phosphoric or phosphonic esters (e.g., diphenyl phosphate, triphenyl phosphate, tricresyl phosphate, 2-ethylhexyl diphenyl phosphate, dioctyl butyl phosphate, tricyclohexyl phosphate, tri-2-ethylhexyl phosphate, tridodecyl phosphate, di-2-ethylhexyl phenyl phosphate), benzoic esters (e.g., 2-ethylhexyl benzoate, 2,4-dichlorobenzoate, dodecyl benzoate, 2-ethylhexyl-p-hydroxybenzoate), amides (e.g., N,N-diethyldodecaneamide, N,N-diethyllaurylamide), alcohols and phenols (e.g., isostearyl alcohol, 2,4-di-tert-amylphenol), aliphatic esters (e.g., dibutoxyethyl succinate, di-2-ethylhexyl succinate, 2-hexyldecyl tetradecanoate, tributyl citrate, diethyl azelate, isostearyl lactate, trioctyl citrate), aniline derivatives (e.g., N,N-dibutyl-2-butoxy-5-tert-octylaniline), chlorinated paraffins (e.g., paraffins having a chlorine content of 10 to 80%), trimesic ester (e.g., tributyl ester of trimesic acid), dodecylbenzene, diisopropylnaphthalene, phenols (e.g., 2,4-di-tert-amylphenol, 4-dodecyloxyphenol, 4-dodecyloxycarbonylphenol, 4-(4-dodecyloxyphenylsulfonyl)-phenol), carboxylic acids (e.g., 2-(2,4-di-tert-amylphenoxybutyric acid, 2-ethoxyoctanedecanoic acid) and alkylphosphoric acids (e.g., di-2-ethylhexylphosphoric acid, diphenylphosphoric acid). Organic solvents having a boiling point of not lower than 30° C., but not higher than about 160° C. may be used as auxiliary solvents together with the high-boiling organic solvents. Examples of the auxiliary solvents include ethyl acetate, butyl acetate, ethyl propionate, methyl ethyl ketone, 2-ethoxyethyl acetate and dimethylformamide.

The high-boiling organic solvents are used in an amount of 0 to 10.0 times, preferably 0 to 6.0 times the weight of the couplers.

The light-sensitive material of the present invention comprises a support having thereon at least one layer containing at least one member of the compounds of general formula (I), (II) or (III). Generally, the light-sensitive material comprises a support having thereon at least one blue-sensitive silver halide emulsion layer, at least one green-sensitive silver halide emulsion layer and at least one red-sensitive silver halide emulsion layer in this order. However, the arrangement of the layers may be made in the reverse order to that described above. If desired, an infrared-sensitive silver halide emulsion layer may be used in place of at least one of the above light-sensitive emulsion layers. Color reproduction by subtractive color photography can be made by supplying color couplers to the light-sensitive emulsion layers. These color couplers form dyes having the relation of complementary colors to the light to which silver halide emulsions, having sensitivity to respective wavelength regions are sensitive. The light-sensitive layers may not correspond to the hue of developed color as described above.

The compounds of the present invention can be applied to, for example, color papers, color reversal papers, direct positive color light-sensitive materials, color negative films, color positive films and reversal color films. It is preferred that the compounds of the present invention are applied to color light-sensitive materials having a reflection support (e.g., color paper, reversal color paper) and color light-sensitive materials which form a positive image (e.g., direct positive color light-sensitive materials, color positive films, reversal color films). It is particularly preferred that the compounds of the present invention are applied to the color light-sensitive materials having a reflection support.

Examples of silver halide which can be used in the present invention include silver chloride, silver bromide, silver chlorobromide, silver iodochlorobromide and silver iodobromide. For the purpose of rapid processing, silver chlorobromide containing substantially no silver iodide and having a silver chloride content of preferably at least 90 mol %, more preferably at least 95 mol %, particularly preferably at least 98 mol %, or pure silver chloride emulsion is preferred.

It is preferred that dyes decolorizable by processing (particularly oxonol dyes) as described in EP0,337,490A2 (pages 27 to 76) are added to the hydrophilic colloid layers of the present invention in such an amount as to give an optical reflection density of at least 0.70 at 680 nm to improve the sharpness of the image; or at least 12 wt % (more preferably at least 14 wt %) of titanium oxide having a surface treated with a bihydric to tetrahydric alcohol (e.g., trimethylol ethane) is contained in the water-resistant resin layer of the support to improve the sharpness of image.

It is preferred that the light-sensitive materials of the present invention contain dye image preservability improving compounds described in EP0,277,589A2 together with the couplers, particularly pyrazoloazole magenta couplers.

Namely, a compound (F) described in EP 0,277,589 A2 and/or a compound (G) described in EP 0,277,589 A2 are/is contained in the light-sensitive materials of the present invention, said compound (F) being chemically bonded to the aromatic amine color developing agent left behind after color development to form a compound which is chemically inert and substantially colorless, and said compound (G) being chemically bonded to the oxidant of the aromatic amine color developing agent left behind to form a compound which is chemically inert and substantially colorless. Accordingly, the use of the compound (F) and/or the compound (G) is preferred from the viewpoint of preventing the formation of a stain caused by the formation of developed dye formed by the reaction of the couplers with the color developing agent or the oxidant thereof left behind in the layers or preventing other side effects from being caused.

It is preferred that the light-sensitive materials of the present invention contain antifungal agents described in JP-A-63-271247 to prevent the image from being deteriorated by the growth of various molds or bacteria in the hydrophilic colloid layers.

Examples of supports which can be used for the light-sensitive materials of the present invention include white polyester supports for display and supports having a white pigment-containing layer on the silver halide emulsion layer side thereof. It is preferred that an antihalation layer is coated on the silver halide emulsion layer-coated side of the support or on the back side thereof. It is particularly preferred that the transmission density of the support is set to a value in the range of 0.35 to 0.8 so as to allow display to be enjoyed by reflected light as well as transmitted light.

The light-sensitive materials of the present invention may be exposed to visible light or infrared light. The exposure method may be a low-illumination exposure or a high-illumination exposure. In the latter case, a laser beam scanning exposure system wherein exposure time per one pixel is shorter than $10^{-4}$ seconds is preferred.

It is preferred that a band stop filter described in U.S. Pat. No. 4,880,726 is used when exposure is conducted, whereby light color mixing can be eliminated and color reproducibility can be greatly improved.

The light-sensitive materials of the present invention can be processed by conventional methods described in RD No. 17643, pp. 28–29 and RD No. 18716 (left column to right column of page 615). For example, a color development stage, a desilverization stage and a rinsing stage are carried out. In the desilverization stage, a bleaching-fixing stage may be carried out, instead of conducting separately a bleaching stage using a bleaching solution and a fixing stage using a fixing solution. A bleaching stage, a fixing stage and a bleaching-fixing stage may be arbitrarily arranged. A stabilization stage may be used in place of the rinsing stage. After the rinsing stage, the stabilization stage may be carried out. A monobath processing stage using a monobath developer bleaching fixer may be used in which color development, bleaching and-fixing are carried out by one bath. In combination with these stages, a prehardening stage, a neutralization stage therefor, a stop fixing stage, an after-hardening stage, a compensating stage and an intensification stage may be optionally used. An intermediate rinsing stage may be used between the above stages. An activator processing stage may be used in place of the color development stage in the processing described above.

Silver halide emulsions, other materials (e.g., additives), photographic constituent layers (e.g., layer arrangement), processing methods and processing additives described in the following patent publications, particularly EP 0,355,660A2 can be preferably applied to the present invention.

| Photographic constituent layer | JP-A-62-215272 | JP-A-2-33144 | EP0,355,660A2 |
|---|---|---|---|
| Silver halide emulsion | The 6th line of right upper column of page 10 to the 5th line of left lower column of page 12; and the 4th line from the bottom of right lower column of page 12 to the 17th line of left upper column of page 13 | The 16th line of right upper column of page 28 to the 11th line of right lower column of page 29; and the 2nd line to the 5th line of page 30 | The 53th line of page 45 to the 3rd line of page 47; and the 20th line to the 22nd line of page 47 |
| Solvents for silver halide | The 6th line to the 14th line of left lower column of page 12; and the third line from the bottom of left upper column of page 13 to the bottom of left lower column of page 18 | — | — |
| Chemical sensitizing agent | The 3rd line from the bottom of left lower column of page 12 to the 5th line from the bottom of page 12; and the first line of right lower column of page 18 to the 9th line from the bottom of right upper column of page 22 | The 12th line to the bottom of right lower column of page 29 | The 4th line to the 9th line of page 47 |
| Spectral sensitizing agent (spectral sensitization method) | The 8th line from the bottom of right upper column of page 22 to the bottom of page 38 | The first line to the 13th line of left upper column of page 30 | The 10th line to the 15th line of page 47 |
| Emulsion stabilizer | The 1st line of left upper column of page 39 to the bottom of right upper column of page 72 | The 14th line of left upper column of page 30 to the first line of right upper column of page 30 | The 16th line to the 19th line of page 47 |

-continued

| Photographic constituent layer | JP-A-62-215272 | JP-A-2-33144 | EP0,355,660A2 |
|---|---|---|---|
| Development accelerator | The 1st line of left lower column of page 72 to the 3rd line of right upper column of page 91 | — | — |
| Color coupler (cyan, magenta and yellow couplers) | The 4th line of right upper column of page 91 to the 6th line of left upper column of page 121 | The 14th line of right upper column of page 3 to the bottom of left upper column of page 18; and the 6th line of right upper column of page 30 to the 11th line of right lower column of page 35 | The 15th line to the 27th line of page 4; the 30th line of page 5 to the bottom of page 28; the 29th line to the 31st line of page 45; and the 23rd line of page 47 to the 50th line of page 63 |
| Supersensitizing agent | The 7th line of left upper column of page 121 to the first line of right upper column of page 125 | — | — |
| Ultraviolet light absorber | The 2nd line of right upper column of page 125 to the bottom of left lower column of page 127 | The 14th line of right lower column of page 37 to the 11th line of left upper column of page 38 | The 22nd line to the 31st line of page 65 |
| Anti-fading agent (image stabilizer) | The 1st line of right lower column of page 127 to the 8th line of left lower column of page 137 | The 12th line of right upper column of page 36 to the 19th line of left upper column of page 37 | The 30th line of page 4 to the 23rd line of page 5; the 1st line of page 29 to the 25th line of page 45; the 33rd line to the 40th line of page 45; and the 2nd line to the 21st line of page 65 |
| High-boiling and/or low-boiling organic solvent | The 9th line of left lower column of page 137 to the bottom of right upper column of page 144 | The 14th line of right lower column of page 35 to the 4th line from the bottom of left upper column of page 36 | The 1st line to the 51st line of page 64 |
| Dispersion method of photographic additive | The 1st line of left lower column of page 144 to the 7th line of right upper column of page 146 | The 10th line of right lower column of page 27 to the bottom of left upper column of page 28; and the 12th line of right lower column of page 35 to the 7th line of right upper column of page 36 | The 51st line of page 63 to the 56th line of page 64 |
| Hardening agent | The 8th line of right upper column of page 146 to the 4th line of left lower column of page 155 | — | — |
| Developing agent precursor | The 5th line of left lower column of page 155 to the 2nd line of right lower column of page 155 | — | — |
| Restrainer releasing compound | The 3rd line to the 9th line of right lower column of page 155 | — | — |
| Support | The 19th line of right lower column of page 155 to the 14th line of left upper column of page 156 | The 18th line of right upper column of page 38 to the 3rd line of left upper column of page 39 | The 29th line of page 66 to the 13th line of page 67 |
| Layer structure | the 15th line of left upper column of page 156 to the 14th line of right lower column of page 156 | The 1st line to the 15th line of right upper column of page 28 | The 41st line to the 52nd line of page 45 |
| Dye | The 15th line of right lower column of page 156 to the bottom of right lower column of page 184 | The 12th line of left upper column of page 38 to the 7th line of right upper column of page 38 | The 18th line to the 22nd line of page 66 |
| Color mixing inhibitor | The 1st line of left upper column of page 185 to the 3rd line of right lower column of page 188 | The 8th line to the 11th line of right upper column of page 36 | The 57th line of page 64 to the 1st line of page 65 |
| Gradation controller | The 4th line to the 8th line of right lower column of page 188 | — | — |
| Stain inhibitor | The 9th line of right lower column of page 188 to the 10th line of right lower column of page 193 | The bottom of left upper column of page 37 to the 13th line of right lower column of page 37 | The 32nd line of page 65 to the 17th line of page 66 |
| Surfactant | The 1st line of left lower column of page 201 to the bottom of right upper column of page 210 | The 1st line of right upper column of page 18 to the bottom of right lower column of page 24; and the 10th line | — |

-continued

| Photographic constituent layer | JP-A-62-215272 | JP-A-2-33144 | EP0,355,660A2 |
|---|---|---|---|
| | | from the bottom of left lower column of page 27 to the 9th line of right lower column of page 27 | |
| Fluorine-containing compound (antistatic agent, coating aid, lubricant, anti-sticking agent, etc.) | The 1st line of left lower column of page 210 to the 5th line of left lower column of page 222 | The 1st line of left upper column of page 25 to the 9th line of right lower column of page 27 | — |
| Binder (hydrophilic colloid) | The 6th line of left lower column of page 222 to the bottom of left upper column of page 225 | The 8th line to the 18th line of right upper column of page 38 | The 23rd line to the 28th line of page 66 |
| Thickener | The 1st line of right upper column of page 225 to the 2nd line of right upper column of page 227 | — | — |
| Antistatic agent | the 3rd line of right upper column of page 227 to the 1st line of left upper column of page 230 | — | — |
| Polymer latex | The 2nd line of left upper column of page 230 to the bottom of page 239 | — | — |
| Matting agent | The 1st line of left upper column of page 240 to the bottom of right upper column of page 240 | — | — |
| Photographic processing method (processing stage, additive, etc.) | The 7th line of right upper column of page 3 to the 5th line of right upper column of page 10 | The 4th line of left upper column of page 39 to the bottom of left upper column of page 42 | The 14th line of page 67 to the 28th line of page 69 |

Note
The cited places of JP-A-62-215272 include an amendment dated March 16, 1987 attached to the end of this publication.
Among the above-described couplers, short wave type yellow couplers described in JP-A-63-231451, JP-A-63-123047, JP-A-63-241547, JP-A-1-173499, JP-A-1-213648, and JP-A-1-250944 can be preferably used as the yellow couplers.

EXAMPLE

The present invention is now illustrated in greater detail by reference to the following examples which, however, are not to be construed as limiting the present invention in any way.

Example 1

There was weighed 16.1 g of yellow coupler Y-1, and 11.5 g of high-boiling organic solvent dibutyl phthalate was added thereto. Further, 24 ml of ethyl acetate was added thereto to dissolve them. The resulting solution was emulsified and dispersed in 200 g of a 10 wt % aqueous gelatin solution containing 1.5 g of sodium dodecylbenzenesulfonate.

The whole amount of the resulting emulsified dispersion was added to 247 g of a high silver chloride emulsion (silver content: 70.0 g/kg of emulsion, silver bromide content: 0.5 mol %), and the resulting emulsion was coated on an undercoated triacetate film base in such an amount as to give a coating weight of 1.73 g/m$^2$ in terms of silver. Further, a gelatin layer as a protective layer was coated on the coated layer in such an amount as to give a dry thickness of 1.0 $\mu$, thus preparing a sample 101. Sodium salt of 1-oxy-3,5-di-chloro-s-triazine was used as a hardening agent for gelatin.

Emulsified dispersions were prepared in the same manner as in the preparation of the emulsified dispersion used in the preparation of the sample 101 except that couplers and dye image stabilizers (used in an amount of 100 mol % based on the amount of the coupler) were co-emulsified as indicated in Table A. In the same manner as in Example 1, emulsions were prepared by using each of the resulting emulsified dispersions, and coated to prepare samples 102 to 138.

Each of the thus-prepared samples was exposed to light through a wedge, and processed in the following processing stages.

| Processing stage | Temperature (°C.) | Time (sec.) |
|---|---|---|
| Color development | 35 | 45 |
| Bleaching-fixing | 30–35 | 45 |
| Rinse (1) | 30–35 | 20 |
| Rinse (2) | 30–35 | 20 |
| Rinse (3) | 30–35 | 20 |
| Drying | 70–80 | 60 |

Each processing solution had the following composition.

| Color developing solution | |
|---|---|
| Water | 800 ml |
| Ethylenediamine-N,N,N',N'-tetramethylene phosphonic acid | 1.5 g |
| Potassium bromide | 0.015 g |
| Triethanolamine | 8.0 g |
| Sodium chloride | 1.4 g |
| Potassium carbonate | 25 g |
| N-Ethyl-N-($\beta$-methanesulfonamidoethyl)-3-methyl-4-aminoaniline sulfate | 5.0 g |

-continued

| | |
|---|---|
| Disodium N,N-bis(sulfonatoethyl)-hydroxylamine | 5.5 g |
| Fluorescent brightener (WHITEX 4B manufactured by Sumitomo Chemical Co., Ltd.) | 1.0 g |
| Water to make | 1000 ml |
| pH (25° C.) | 10.05 |
| Bleaching-fixing solution | |
| Water | 400 ml |
| Ammonium thiosulfate (700 g/l) | 100 ml |
| Sodium sulfite | 17 g |
| Ammonium (ethylenediaminetetraacetato) iron (III) | 55 g |
| Disodium ethylenediaminetetraacetate | 5 g |
| Ammonium bromide | 40 g |
| Water to make | 1000 ml |
| pH (25° C.) | 6.0 |
| Rinsing solution | |
| Ion-exchanged water (The concentration of each of calcium ion and magnesium ion being reduced to not higher than 3 ppm) | |

Each of the samples 101 to 138 having a dye image formed thereon was exposed to light through an ultraviolet light absorbing filter (manufactured by Fuji Photo Film Co., Ltd.) which cut light having a wave-length of not longer than 400 nm for 8 days by using a xenon tester (illuminance: 200,000 lx). The yellow density (stain) of the unexposed area of each sample was measured, and the residual ratio of the density at an initial density of 1.0 was determined.

The measurement was made by using Fuji automatic recording densitometer.

The results are shown in Table A.

TABLE A

| Sample | Coupler | Dye image stabilizer | Stain | Residual ratio of yellow density (initial density: 1.0, Xe: 200,000 1x for 8 days) (%) | Remarks |
|---|---|---|---|---|---|
| 101 | Y-1 | — | 0.16 | 46 | Comp. Ex. |
| 102 | " | Comparative compound 1 | 0.17 | 49 | " |
| 103 | " | Comparative compound 2 | 0.20 | 48 | " |
| 104 | " | Comparative compound 3 | 0.17 | 42 | " |
| 105 | " | Comparative compound 4 | 0.18 | 44 | " |
| 106 | " | Comparative compound 5 | 0.19 | 47 | " |
| 107 | " | Comparative compound 6 | 0.19 | 42 | " |
| 108 | " | Comparative compound 7 | 0.23 | 38 | " |
| 109 | " | Comparative compound 8 | 0.21 | 29 | " |
| 110 | " | Comparative compound 9 | 0.20 | 28 | " |
| 111 | " | Comparative compound 11 | 0.18 | 39 | " |
| 112 | " | Comparative compound 12 | 0.16 | 55 | " |
| 113 | " | I-a-1 | 0.14 | 75 | Invention |
| 114 | " | I-a-10 | 0.12 | 82 | " |
| 115 | " | I-a-14 | 0.13 | 78 | " |
| 116 | " | II-a-3 | 0.11 | 84 | " |
| 117 | " | II-a-9 | 0.12 | 80 | " |
| 118 | " | II-a-15 | 0.11 | 85 | " |
| 119 | " | III-3 | 0.12 | 76 | " |
| 120 | Y-1 | III-10 | 0.13 | 78 | Invention |
| 121 | " | III-14 | 0.12 | 82 | " |
| 122 | " | III-17 | 0.11 | 81 | " |
| 123 | Y-3 | — | 0.16 | 45 | Comp. Ex. |
| 124 | " | Comparative compound 4 | 0.17 | 48 | " |
| 125 | " | Comparative compound 11 | 0.19 | 42 | " |
| 126 | " | Comparative compound 12 | 0.17 | 49 | " |
| 127 | " | I-a-10 | 0.11 | 82 | Invention |
| 128 | " | II-a-9 | 0.11 | 80 | " |
| 129 | " | III-3 | 0.11 | 84 | " |
| 130 | " | III-14 | 0.11 | 83 | " |
| 131 | Y-6 | — | 0.16 | 42 | Comp. Ex. |
| 132 | " | Comparative compound 4 | 0.16 | 46 | " |
| 133 | " | Comparative compound 11 | 0.17 | 47 | " |
| 134 | " | Comparative compound 12 | 0.16 | 48 | " |
| 135 | " | I-a-10 | 0.12 | 86 | Invention |
| 136 | " | II-a-9 | 0.11 | 82 | " |
| 137 | " | III-3 | 0.11 | 85 | " |
| 138 | " | III-14 | 0.11 | 84 | " |

Comparative compound 1

$(C_{12}H_{25}SCH_2CH_2CO_2CH_2)_4C$

Compound described in U.S. Pat. No. 4,540,658

Comparative compound 2

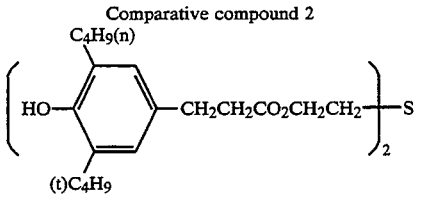

Compound described in U.S. Pat. No. 4,540,658

Comparative compound 3

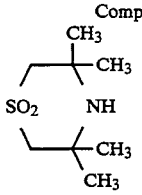

Compound described in U.K. Pat. No. 1,410,846

Comparative compound 4

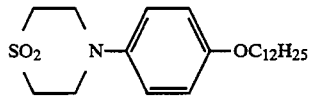

Compound described in U.S. Pat. No. 4,880,773

Comparative compound 5

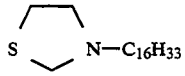

Compound described in JP-A-63-43146

Comparative compound 6

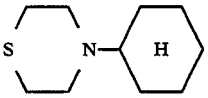

Compound described in European Patent Laid-Open No. 178794

-continued

Comparative compound 7

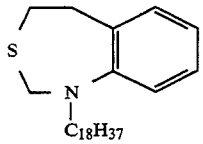

Compound described in JP-A-63-149644

Comparative compound 8

$C_{12}H_{25}CH(CO_2C_2H_5)SH$

Compound described in U.S. Pat. No. 4,704,350

Comparative compound 9

$S(CH_2CH_2CO_2C_{12}H_{25})_2$

Compound described in JP-A-62-103642

Comparative compound 10

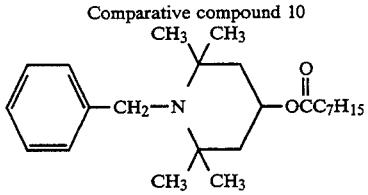

Compound described in U.S. Pat. No. 5,104,781

Comparative compound 11

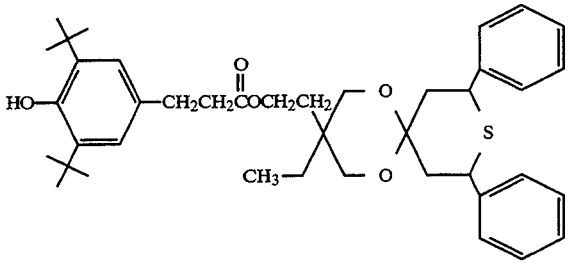

Compound described in European Patent Laid-open Nos. 310551 and 310552

Comparative compound 12

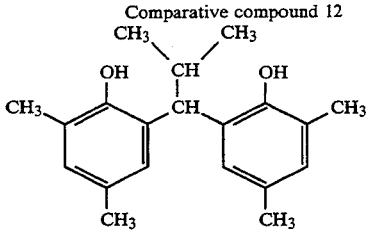

Compound described in JP-A-3-48241, JP-A-3-48845 and JP-A-3-51846

It can be seen from the above results that the compounds of the present invention are effective in preventing dye images from being faded by light and are also effective in preventing unexposed areas from being yellowed. The results show that the compounds of the present invention have an excellent effect which cannot be expected from conventional compounds.

Example 2

A sample 201 was prepared in the same manner as in the preparation of the sample 101 of Example 1 except that 16.1 g of magenta coupler (M-1) was used in place of yellow coupler used in the sample 101 of Example 1.

Emulsified dispersions were prepared in the same manner as in the preparation of the emulsified dispersion used in the preparation of the sample 201 except that couplers and dye image stabilizers (used in an amount of 100 mol % based on the amount of the coupler) were co-emulsified as indicated in Table B. In the same manner as in the preparation of the sample 201, emulsions were prepared by using each of the resulting emulsified dispersions and coated to prepare samples 202 to 222.

The same comparative compounds as those used in Example 1 were used.

In the same manner as in Example 1, each of the thus-prepared samples was exposed and processed. Each of the samples 201 to 222 having a dye image formed thereon was exposed to light though an ultraviolet light absorbing filter (manufactured by Fuji Photo Film Co., Ltd.) which cut light having a wavelength of not longer than 400 nm for 10 days by using a xenon tester (illuminance: 200,000 lx). The yellow density (stain) of the unexposed area of each sample was measured, and the residual ratio of the density at an initial density of 1.0 was determined.

The measurement was made by using Fuji automatic recording densitometer.

The results are shown in Table B.

TABLE B

| Sample | Coupler | Dye image stabilizer | Stain | Residual ratio of magenta density (initial density: 1.0, Xe: 200,000 1x for 10 days) (%) | Remarks |
|---|---|---|---|---|---|
| 201 | M-1 | — | 0.14 | 6 | Comp. Ex. |
| 202 | " | Comparative compound 2 | 0.15 | 49 | " |
| 203 | " | Comparative compound 5 | 0.16 | 48 | " |
| 204 | " | Comparative compound 12 | 0.15 | 42 | " |
| 205 | " | I-a-10 | 0.12 | 80 | Invention |
| 206 | " | II-a-9 | 0.11 | 82 | " |
| 207 | " | III-3 | 0.11 | 85 | " |
| 208 | " | III-14 | 0.12 | 84 | " |
| 209 | M-4 | — | 0.15 | 12 | Comp. Ex. |
| 210 | " | Comparative compound 2 | 0.15 | 55 | " |
| 211 | " | Comparative compound 12 | 0.15 | 39 | " |
| 212 | " | I-a-1 | 0.12 | 87 | Invention |
| 213 | " | I-a-10 | 0.13 | 88 | " |
| 214 | " | II-a-10 | 0.12 | 86 | " |
| 215 | " | III-3 | 0.12 | 85 | " |
| 216 | " | III-10 | 0.13 | 84 | " |
| 217 | M-8 | — | 0.20 | 5 | Comp. Ex. |
| 218 | " | Comparative compound 5 | 0.20 | 42 | " |
| 219 | " | I-a-10 | 0.17 | 82 | Invention |
| 220 | " | II-a-10 | 0.18 | 78 | " |
| 221 | " | III-3 | 0.17 | 86 | " |
| 222 | " | III-17 | 0.17 | 85 | " |

It can be seen from the above results that when magenta couplers are used, the compounds of the present invention have an excellent anti-fading effect, and the effect obtained thereby is very superior in comparison with comparative compounds.

Example 3

A sample 301 was prepared in the same manner as in the preparation of the sample 101 of Example 1 except that 9.8 g of cyan coupler (C-1) was used in place of yellow coupler used in the sample 101 of Example 1.

Emulsified dispersions were prepared in the same manner as in the preparation of the emulsified dispersion used in the preparation of the sample 101 of Example 1 except that couplers and dye image stabilizers (used in an amount of 100 mol % based on the amount of the coupler) were co-emulsified as indicated in Table C. In the same manner as in the preparation of the sample 101 of Example 1, emulsions were prepared by using each of the resulting emulsified dispersions and coated to prepare samples 301 to 312.

In the same manner as in Example 1, each of the thus-obtained samples was exposed and processed. Each of the samples 301 to 312 having a dye image formed thereon was exposed to light through an ultraviolet light absorbing filter (manufactured by Fuji Photo Film Co., Ltd.) which cut light having a wavelength of not longer than 400 nm for 8 days by using a xenon tester (illuminance: 200,000 lx). The yellow density (stain) of the unexposed area of each sample was measured, and the residual ratio of the density at an initial density of 1.0 was determined.

The measurement was made by using Fuji automatic recording densitometer.

The results are shown in Table C.

TABLE C

| Sample | Coupler | Dye image stabilizer | Stain | Residual ratio of cyan density (initial density: 1.0, Xe: 200,000 1x for 8 days) (%) | Remarks |
|---|---|---|---|---|---|
| 301 | C-1 | — | 0.18 | 48 | Comp. Ex. |
| 302 | " | Comparative compound 6 | 0.20 | 50 | " |
| 303 | " | Comparative compound 8 | 0.19 | 48 | " |
| 304 | " | Comparative compound 11 | 0.18 | 49 | " |
| 305 | " | I-a-1 | 0.11 | 78 | Invention |
| 306 | " | II-a-10 | 0.15 | 80 | " |
| 307 | " | III-3 | 0.16 | 84 | " |
| 308 | " | III-10 | 0.17 | 82 | " |
| 309 | C-5 | — | 0.22 | 32 | Comp. Ex. |
| 310 | " | Comparative compound 12 | 0.24 | 30 | " |
| 311 | " | I-a-10 | 0.20 | 78 | Invention |
| 312 | " | II-a-9 | 0.18 | 80 | " |

It can be seen from the above results that when cyan couplers are used, the compounds of the present invention have an excellent anti-fading effect and the effect obtained thereby is very superior in comparison with comparative compounds.

Example 4

Both sides of a paper support were laminated with polyethylene. The surface of the polyethylene-laminated paper support was subjected to a corona discharge treatment, and then coated with a gelatin undercoat layer containing sodium dodecylbenzenesulfonate. Further, various photographic constituent layers were coated thereon to prepare a multi-layer color photographic paper having the following layer structure (sample 101). Coating solutions were prepared in the following manner.

Preparation of Coating Solution for First Layer

There was dissolved 153.0 g of yellow coupler (ExY) in 25 g of solvent (Solv-1), 25 g of solvent (Solv-2) and 180 cc of ethyl acetate. The resulting solution was emulsified and dispersed in 1,000 g of a 10% aqueous gelatin solution containing 60 cc of 10% sodium dodecylbenzenesulfonate and 10 g of citric acid to prepare an emulsified dispersion A. Separately, a silver chlorobromide emulsion A (cubic; a 3:7 (by mol of Ag) mixture of a larger-size emulsion A having an average grain size of 0.88 μm and a smaller-size emulsion A having a mean grain size of 0.70 μm; a coefficient of variation in a grain size distribution: 0.08 and 0.10, respectively; 0.3 mol % of silver bromide being localized on a part of the surface of the grain in each size emulsion) was prepared. The following blue-sensitive sensitizing dyes A and B were added to the emulsion ($2.0\times10^{-4}$ mol of each of the dyes A and B was added to the larger-size emulsion A, and $2.5\times10^{-4}$ mol of each of them was added to the smaller-size emulsion A). The chemical ripening of the emulsion was carried out by adding a sulfur sensitizing agent and a gold sensitizing agent. The above emulsified dispersion A and the silver chlorobromide emulsion A were mixed and dissolved, and a coating solution for the first layer was prepared so as to give the following composition.

Coating solutions for the second layer through the seventh layer were prepared in the same manner as in the preparation of the coating solution for the first layer. Sodium salt of 1-oxy-3,5-dichloro-s-triazine was used as the hardening agent for gelatin in each layer.

Further, Cpd-10 and Cpd-11 were added to each layer in such an amount as to give the total weights of 25.0 mg/m$^2$ and 50.0 mg/m$^2$, respectively.

The following spectral sensitizing dyes were used for the silver chlorobromide emulsion in each light-sensitive emulsion layer.

Blue-sensitive emulsion layer

Sensitizing dye A

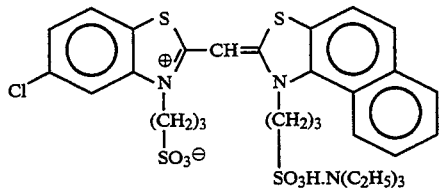

Sensitizing dye B

-continued

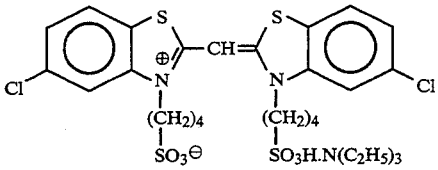

Green-sensitive emulsion layer

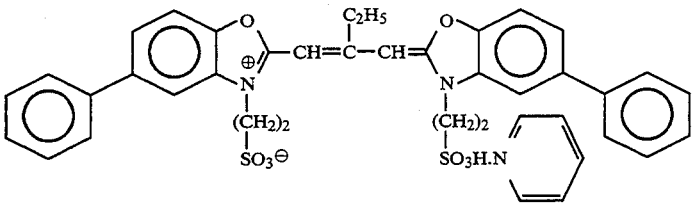

($4.0 \times 10^{-4}$ mol being added to the larger-size emulsion B, and $5.6 \times 10^{-4}$ mol being added to the smaller-size emulsion B, each amount being per mol of silver halide)

Sensitizing dye D

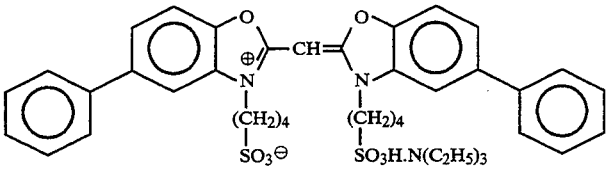

($7.0 \times 10^{-5}$ mol being added to the larger-size emulsion B, and $1.0 \times 10^{-5}$ mol being added to the smaller-size emulsion B, each amount being per mol of silver halide)

Red-sensitive emulsion layer

Sensitizing dye E

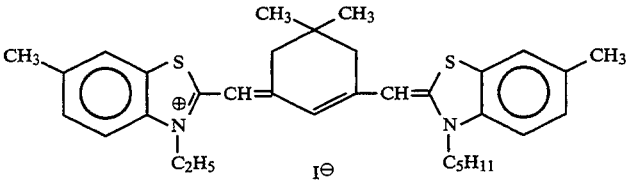

Compound F

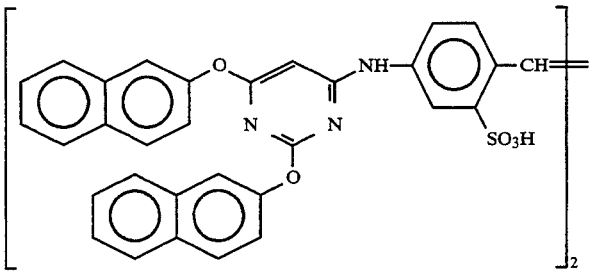

Further, $8.5 \times 10^{-5}$ mol, $7.7 \times 10^{-4}$ mol and $2.5 \times 10^{-4}$ mol of 1-(5-methylureidophenyl)-5-mercaptoethanol were added to the blue-sensitive emulsion layer, the green-sensitive emulsion layer and the red-sensitive emulsion layer, respectively, each amount being per mol of silver halide.

Further, $1 \times 10^{-4}$ mol and $2 \times 10^{-4}$ mol of 4-hydroxy-6-methyl-1,3,3a,7-tetrazaindene were added to the blue-sensitive emulsion layer and the green-sensitive emulsion layer, respectively, each amount being per mol of silver halide.

The following dyes (parenthesized numerals being coating weights) were added to the emulsion layers to prevent irradiation.

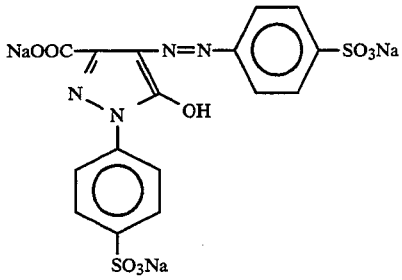

(10 mg/m²)

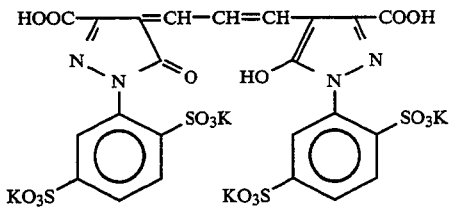

(10 mg/m²)

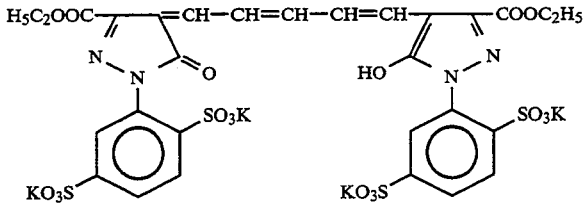

(40 mg/m²)

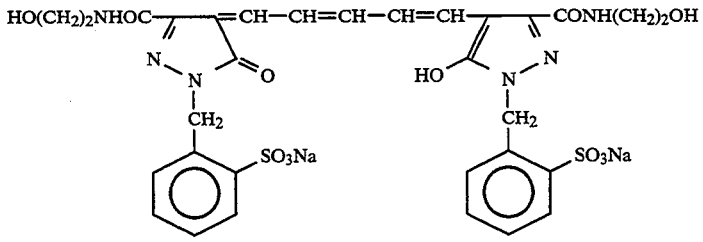

(20 mg/m²)

Layer Structure

Each layer had the following composition. Numerals represent coating weight (g/m²). The amounts of the silver halide emulsions are represented by coating weight in terms of silver.

Support

Polyethylene-laminated paper [Polyethylene on the first layer side contained white pigment ($TiO_2$) and bluish dye (ultramarine)]

| | |
|---|---|
| First layer (blue-sensitive emulsion layer) | |
| The above silver chlorobromide emulsion A | 0.27 |
| Gelatin | 1.36 |
| Yellow coupler (ExY) | 0.79 |
| Solvent (Solv-1) | 0.13 |
| Solvent (Solv-2) | 0.13 |
| Second layer (color mixing inhibiting layer) | |
| Gelatin | 1.00 |
| Color mixing inhibitor (Cpd-4) | 0.06 |
| Solvent (Solv-7) | 0.03 |
| Solvent (Solv-2) | 0.25 |
| Solvent (Solv-3) | 0.25 |
| Third layer (green-sensitive emulsion layer) | |
| Silver chlorobromide emulsion B (cubic; a 1:3 (by mol of Ag) mixture of a larger-size emulsion B having a mean grain size of 0.55 μm and a smaller-size emulsion B having a mean grain size of 0.39 μm; a coefficient of variation in a grain size distribution: 0.10 and 0.08, respectively; 0.8 mol % of AgBr being localized on a part of the surface of the grain in each size emulsion) | 0.13 |
| Gelatin | 1.45 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| Fourth layer (color mixing inhibiting layer) | |
| Gelatin | 0.70 |
| Color mixing inhibitor (Cpd-4) | 0.04 |
| Solvent (Solv-7) | 0.02 |
| Solvent (Solv-2) | 0.18 |
| Solvent (Solv-3) | 0.18 |
| Fifth layer (red-sensitive emulsion layer) | |
| Silver chlorobromide emulsion C (Cubic; a 1:3 (by mol of Ag) mixture of a larger-size emulsion C having a mean grain size of 0.50 μm and a smaller-size emulsion C having | 0.18 |

-continued

| | |
|---|---|
| a mean grain size of 0.41 μm; a coefficient of variarion in a grain size of distribution: 0.09 and 0.11, respectively; 0.8 mol % of AgBr being localized on a part of the surface of the grain in each size emulsion) | |
| Gelatin | 0.85 |
| Cyan coupler (ExC) | 0.25 |
| Ultraviolet light absorber (UV-2) | 0.18 |
| Dye image stabilizer (Cpd-1) | 0.25 |
| Dye image stabilizer (Cpd-6) | 0.01 |
| Dye image stabilizer (Cpd-7) | 0.01 |
| Dye image stabilizer (Cpd-8) | 0.03 |
| Dye image stabilizer (Cpd-9) | 0.01 |
| Dye image stabilizer (Cpd-10) | 0.01 |
| Solvent (Solv-6) | 0.20 |
| Solvent (Solv-1) | 0.01 |
| Sixth layer (ultraviolet light absorbing layer) | |
| Gelatin | 0.55 |
| Ultraviolet light absorber (UV-1) | 0.38 |
| Dye image stabilizer (Cpd-12) | 0.15 |
| Dye image stabilizer (Cpd-5) | 0.02 |
| Seventh layer (protective layer) | |
| Gelatin | 1.13 |
| Acrylic-modified copolymer of polyvinyl alcohol (a degree of modification: 17%) | 0.05 |
| Liquid paraffin | 0.02 |
| Dye image stabilizer (Cpd-13) | 0.01 |

(ExY) Yellow coupler

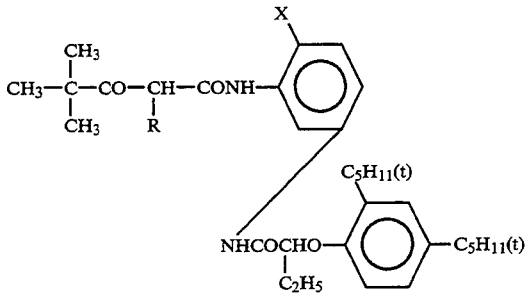

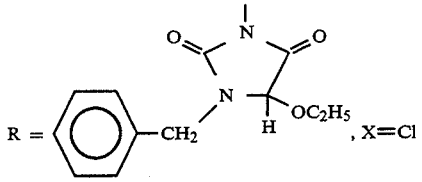

and
1:1 mixture (by mol)

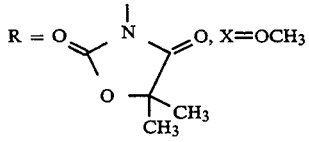

(ExM) Magenta coupler

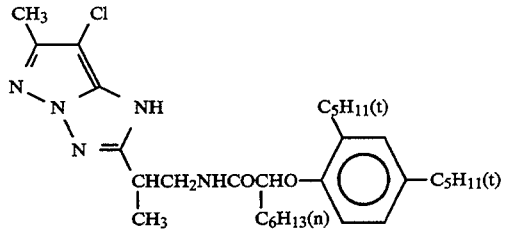

-continued (ExC) Cyan coupler

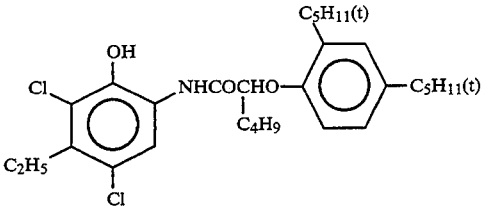

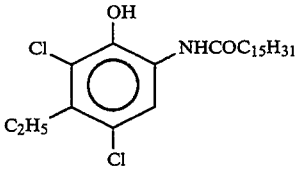

3:7 mixture (by mol)

(Cpd-4) Color mixing inhibitor

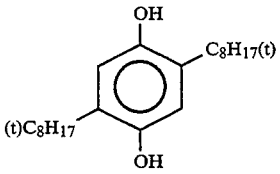

(Cpd-5) Dye image stabilizer

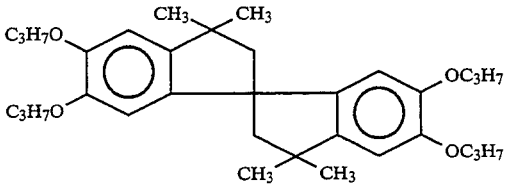

(Cpd-6)

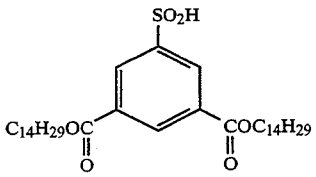

(Cpd-7)

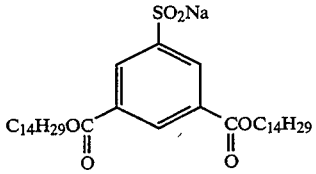

(Cpd-8) Dye image stabilizer

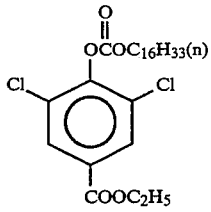

-continued
(Cpd-9) Dye image stabilizer
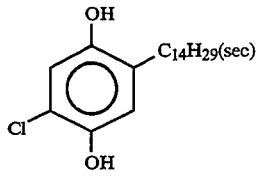
(Cpd-10) Dye image stabilizer
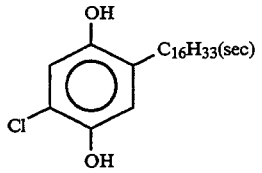
(Cpd-11)
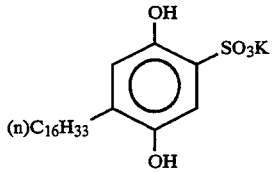
(Cpd-12)
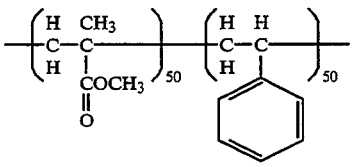
Average Mol. Wt. 60,000
(Cpd-13)
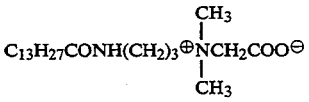
(Cpd-14) Antiseptic
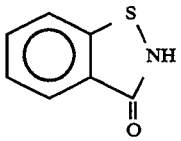
(Cpd-15) Antiseptic
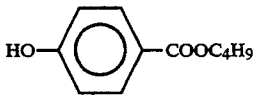
(UV-1) Ultraviolet light absorber
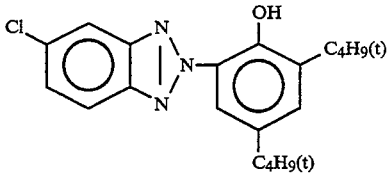
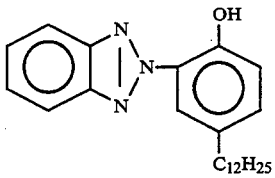
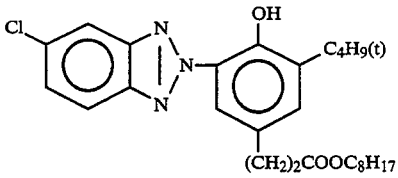
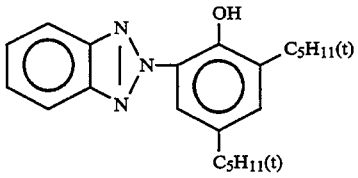
10:5:1:5 mixture (by weight)
(UV-2) Ultraviolet light absorber
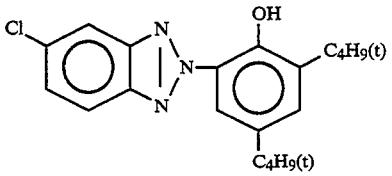
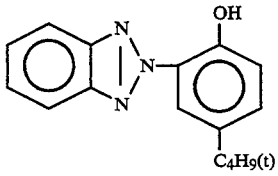
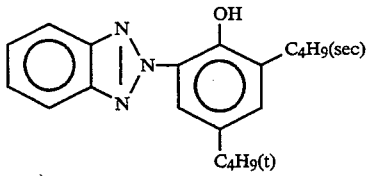
1:2:2 mixture (by weight)
(Solv-1) Solvent
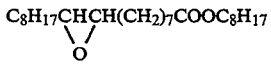
(Solv-2) Solvent
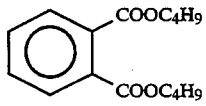

-continued (Solv-3) Solvent

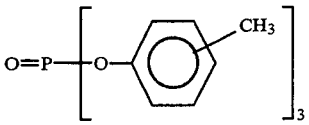

(Solv-4) Solvent

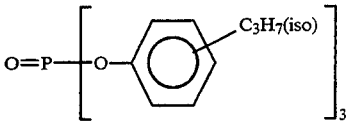

(Solv-5) Solvent

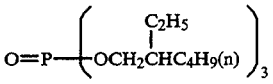

(Solv-6) Solvent

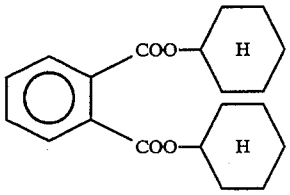

(Solv-7) Solvent

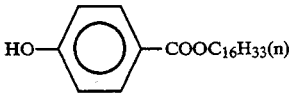

Each sample was subjected to gradation exposure through a three-color separation filter for sensitometry by using a sensitometer (FWH type, color temperature of light source: 3,200° K. manufactured by Fuji Photo Film Co., Ltd.). The exposure time was 0.1 second, and the exposure amount was 250 MSC.

The exposed sample was subjected to continuous processing (running test) by using a paper processor until the replenishment rate reached twice the tank capacity of the color developing solution. The following processing stages and the following processing solutions were used.

| Processing stage | Temp. | Time | Replenishment rate* | Tank capacity |
|---|---|---|---|---|
| Color development | 35° C. | 45 sec | 161 ml | 17 l |
| Bleaching-fixing | 30–35° C. | 45 sec | 215 ml | 17 l |
| Rinse | 30° C. | 90 sec | 350 ml | 10 l |
| Drying | 70–80° C. | 60 sec | | |

*Replenishment rate being per $m^2$ of light-sensitive material

Each processing solution had the following composition.

| Color developing solution | Tank Solution | Replenisher |
|---|---|---|
| Water | 800 ml | 800 ml |
| Ethylenediamine-N,N,N',N'-tetramethylenephosphonic acid | 1.5 g | 2.0 g |
| Potassium bromide | 0.015 g | |
| Triethanolamine | 8.0 g | 12.0 g |
| Sodium chloride | 1.4 g | |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)-hydrazine | 4.0 g | 5.0 g |
| Monosodium salt of N,N-bis-(sulfoethyl)hydroxylamine | 4.0 g | 5.0 g |
| Fluorescent brightener (WHITEX 4B manufacture by Sumitomo Chemical Co., Ltd.) | 1.0 g | 2.0 g |
| Water to make | 1000 ml | 1000 ml |
| pH (25° C.) | 10.05 | 10.45 |

| Bleaching-fixing solution<br>Tank solution and replenisher being the same. | |
|---|---|
| Water | 400 ml |
| Ammonium thiosulfate (700 g/l) | 100 ml |
| Sodium sulfite | 17 g |
| Ammonium (ethylenediaminetetraacetato) iron (III) | 55 g |
| Disodium ethylenediaminetetraacetate | 5 g |
| Ammonium bromide | 40 g |
| Water to make | 1000 ml |
| pH (25° C.) | 6.0 |

| Rinsing water<br>Tank solution and replenisher being the same. |
|---|
| Ion-exchanged water<br>(The concentration of each of calcium ion and magnesium ion was reduced to not higher than 3 ppm). |

The thus-obtained sample was referred to as sample 1A. Samples 2A to 8A were prepared in the same manner as in the preparation of the sampler 1A except that the yellow coupler used in the first layer was co-emulsified with dye image stabilizer as indicated in Table D. An equimolar amount of each compound was used.

The same comparative compounds as those used in Example 1 were used.

Each of the samples having a dye image formed thereon was subjected to a fading test. The evaluation of an anti-fading effect was made by determining the residual ratio of yellow density at an initial density of 2.0 after the samples were exposed to light for 10 days by using a xenon tester (illuminance: 200,000 lx).

The results are shown in Table D.

TABLE D

| Sample | Coupler | Dye image stabilizer | Stain | Residual ratio of yellow density (initial density: 2.0, Xe: 200,000 1x for 10 days) (%) | Remarks |
|---|---|---|---|---|---|
| 1A | ExY | — | 0.14 | 66 | Comp. Ex. |
| 2A | " | Comparative compound 11 | 0.17 | 64 | " |
| 3A | " | Comparative compound 12 | 0.18 | 70 | " |
| 4A | " | I-a-10 | 0.11 | 85 | Invention |
| 5A | " | I-a-9 | 0.11 | 84 | " |
| 6A | Y-10 | — | 0.16 | 51 | Comp. Ex. |
| 7A | " | III-3 | 0.12 | 82 | Invention |
| 8A | " | III-14 | 0.2 | 80 | " |

It can be seen form Table 5 that the samples of the present invention which contain the compounds of the present invention have an excellent effect as in Example 1 even when the samples are multi-layer light-sensitive materials.

Example 5

Samples were prepared in the same manner as in the preparation of the sample 101 of Example 1 of JP-A-2-854 except that the compound (I-a-l),. (I-a-10), (II-a-12), (III-10) or (III-18) of the present invention in an amount of 25 mol % based on the amount of the coupler was added to the third layer, the fourth layer and the fifth layer of the sample 101.

Further, samples were prepared in the same manner as in the preparation of the sample 101 except that the compound (I-a-16), (I-a-21), (II-a-3), (III-18) or (III-21) of the present invention in an amount of 25 mol % based on the amount of the coupler was added to the 12th layer and the 13th layer of the sample 101.

In the same manner as in Example 1 of JP-A-2-854, the samples were exposed, processed and subjected to a fading test. It was found that the compounds of the present invention had an excellent anti-fading effect a good effect on photographic characteristics.

Accordingly, it was found that the compounds of the present invention have an excellent effect, even when used in the above light-sensitive material.

Example 6

Samples were prepared in the same manner as in the preparation of the color photographic material of Example 2 of U.S. Pat. No. 5,079,132 except that an equimolar amount of the compound (I-a-10), (I-a-16), (II-a-6), (III-10) or (III-15) of the present invention was used in place of Cpd-9 used in the 6th layer and the 7th layer of the color photographic material of Example 2 of U.S. Pat. No. 5,079,132.

Further, samples were prepared in the same manner as in the preparation of the color photographic material of Example 2 of U.S. Pat. No. 5,079,132 except that an equimolar amount of the compound (I-a-16), (I-a-21), (II-a-3), (III-18) or (III-21) of the present invention was used in place of Cpd-6 used in the 11th layer and 12th layer of the color photographic material of Example 2 of U.S. Pat. No. 5,079,132.

In the same manner as in Example 2 of U.S. Pat. No. 5,079,132, these samples were exposed, processed and subjected to a fading test to examine photographic characteristics. It was found that the samples of the present invention had an excellent anti-fading effect and good photographic characteristics.

Accordingly, it was found that the compounds of the present invention had an excellent effect even when used in the above light-sensitive material.

Example 7

Samples were prepared in the same manner as in the preparation of the sample 101 of Example 1 of U.S. Pat. No. 5,071,736 except that the compound (I-a-l), (I-a-10), (II-a-12), (III-10) or (III-18) of the present invention in an amount of 25 mol % based on the amount of the coupler was used in each of the 12th layer and the 13th layer of the sample 101.

In the same manner as in Example 1 of U.S. Pat. No. 5,071,736, these samples were exposed, processed and subjected to a fading test. It was found that the samples of the present invention had an excellent anti-fading effect and good photographic characteristics.

Accordingly, it was found that the compounds of the present invention had an excellent effect even when used in the above light-sensitive material.

It will be understood from the above disclosure that according to the present invention there can be obtained a silver halide color photographic material which gives a dye image with good color reproducibility after processing and is greatly improved in fastness to light in comparison with conventional anti-fading agents, and moreover which scarcely suffers from the formation of stain in the unexposed area and gives well-balanced color in connection with fading.

While the present invention has been described in detail and with reference to specific embodiments thereof, it is apparent to one skilled in the art that various changes and modifications can be made therein without departing from the spirit and the scope of the present invention.

What is claimed is:

1. A silver halide color photographic material comprising a support having thereon at least one layer containing at least one compound represented by the following formula (I), (II) or (III):

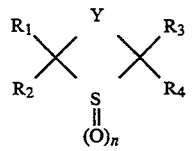

(I)

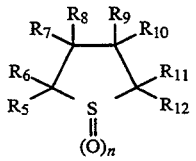

(II)

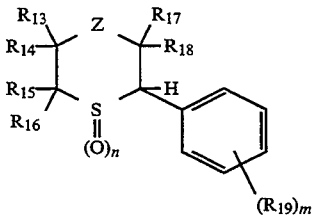

(III)

wherein $R_1$, $R_2$, $R_3$, $R_4$, $R_5$, $R_6$, $R_{11}$ and $R_{12}$ may be the same or different and each represents a hydrogen atom, an alkyl group, an aryl group or a heterocyclic group; Y represents a group of the following formula:

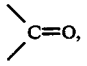

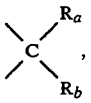

or

-continued

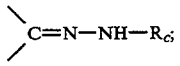

$R_a$, $R_b$, $R_7$, $R_8$, $R_9$, $R_{10}$, $R_{13}$, $R_{14}$, $R_{15}$, $R_{16}$, $R_{17}$ and $R_{18}$ may be the same or different and each represents a hydrogen atom or a substituent group, or $R_a$ and $R_b$ may be combined together to form a five-membered to seven-membered ring; $R_c$ represents an acyl group; $R_{19}$ represents a substituent group; Z represents —S—, —SO—, —$SO_2$—, —O— or —N($R_{20}$)—; $R_{20}$ has the same meaning as $R_{13}$; n represents 0 or an integer of 1 to 2; and m represents 0 or an integer of 1 to 5 and when m is 2 to 5, two or more $R_{19}$ groups may be the same or different, wherein said compound of formula (I) is a compound represented by the following formula (I-a):

(I-a)

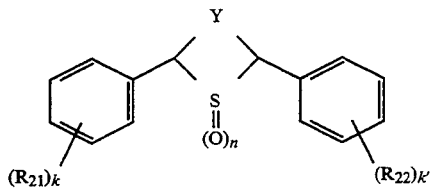

wherein n and Y are as defined in general formula (I); $R_{21}$ and $R_{22}$ may be the same or different and each represents a substituent group; k and k' each represents 0 or an integer of 1 to 5; when k and k' are each 2 or greater, two or more $R_{21}$ and $R_{22}$ groups may be the same or different, and the $R_{21}$ or $R_{22}$ groups at the ortho-position relative to each other may be combined together to form a five-membered to seven-membered ring, and wherein said compound of formula (II) is a compound represented by the following formula (II-a):

(II-a)

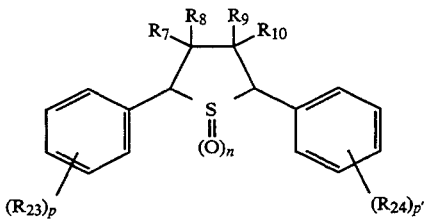

wherein $R_7$, $R_8$, $R_9$, $R_{10}$ and n are the same as defined in general formula (II); $R_{23}$ and $R_{24}$ may be the same or different and each represents a substituent group; and p and p' each represents 0 or an integer of 1 to 5; when p and p' are each 2 or greater, two or more $R_{23}$ and $R_{24}$ groups may be the same or different, and the $R_{23}$ and $R_{24}$ groups at the ortho-position relative to each other may be combined together to a form five-membered to seven-membered ring.

2. The silver halide color photographic material as in claim 1, wherein said substituent group is selected from the group consisting of an alkyl group, an alkenyl group, an alkynyl group, an aryl group, a heterocyclic group, a halogen atom, a cyano group, a nitro group, a hydroxyl group, an alkoxy group, an aryloxy group, an alkylthio group, an arylthio group, an acyloxy group, a sulfonyloxy group, an unsubstituted amino group, an alkylamino group, an arylamino group, an acylamino group, a sulfonamido group, an oxycarbonylamino group, an oxysulfonylamino group, a ureido group, an acyl group, an oxycarbonyl group, a carbamoyl group, a sulfonyl group, a sulfinyl group, an oxysulfonyl group and a sulfamoyl group, wherein except for said halogen atom, said cyano group, said nitro group, and said hydroxyl group, each of the above groups may optionally be further substituted.

3. The silver halide color photographic material as in claim 1, wherein $R_a$ and $R_b$ in formula (I) and $R_7$, $R_8$, $R_9$ and $R_{10}$ in formula (II) are each independently selected from the group consisting of a hydrogen atom, a hydroxyl group, an acyloxy group, an alkyl group, an aryl group, an alkoxy group, an aryloxy group, an alkylthio group, an arylthio group, alkylamino group, an arylamino group, a carbamoyl group, a sulfonamido group, and an acyl group; and $R_a$ and $R_b$ may be combined together to form a five-membered to seven-membered ring.

4. The silver halide color photographic material as in claim 1, where $R_a$ and $R_b$ are independently selected from the group consisting of a hydrogen atom, an acyloxy group, and an alkoxy group, and wherein $R_7$, $R_8$, $R_9$, and $R_{10}$ are each independently selected from the group consisting of a hydrogen atom, an acyloxy group, an alkyl group, an aryl group, an alkylthio group, and an alkoxy group.

5. The silver halide color photographic material as in claim 1, wherein said acyl group represented by $R_c$ is selected from the group consisting of an acetyl group, a benzoyl group, a pivaloyl group, a cyclopropionyl group, an α-(2,4-di-tert-amylphenoxy)butyryl group, a myristoyl group, a stearoyl group, a naphthoyl group, a m-pentadecylbenzoyl group, and an isonicotinoyl. group 6. The silver halide color photographic material as in claim 1, wherein $R_{21}$ and $R_{22}$ are each independently selected from the group consisting of an alkyl group, an aryl group, a heterocyclic group, an alkoxy group, an aryloxy group, an alkylthio group, an arylthio group, an alkoxycarbonyl group, a carbamoyl group and an acyl group.

7. The silver halide color photographic material as in claim 1, wherein Y in formula (I) represents a group of the following formula:

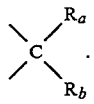

8. The silver halide color photographic material as in claim 1, wherein n in formulas (I) and (II) is 0 or 2.

9. The silver halide color photographic material as in claim 1, wherein $R_{23}$ and $R_{24}$ are each independently selected from the group consisting of an alkyl group, an aryl group, a heterocyclic group, an alkoxy group, an aryloxy group, an alkylthio group, an arylthio group, an alkoxycarbonyl group, a carbamoyl group and an acyl group.

10. The silver halide color photographic material as in claim 1, wherein $R_{13}$, $R_{14}$, $R_{15}$, $R_{16}$, $R_{17}$ and $R_{18}$ in formula (III) are independently selected from the group consisting of a hydrogen atom, an alkyl group, an alkenyl group, an alkynyl group, an aryl group, a heterocyclic group, a halogen atom, a cyano group, a nitro group, a hydroxy group, an alkoxy group, an aryloxy group, an alkylthio group, an arylthio group, an acyloxy group, a sulfonyloxy group, an unsubstituted amino group, an alkylamino group, an arylamino group, an acylamino group, a sulfonamido group, an oxycarbonylamino group, an oxysulfonylamino group, a ureido group, an acyl group, an oxycarbonyl group, a carbamoyl group, a sulfonyl group, a sulfinyl group, an oxysulfonyl group, and a sulfamoyl group.

11. The silver halide color photographic material as in claim 10, wherein $R_{15}$ is an aryl group and $R_{16}$ is a hydrogen atom.

12. The silver halide color photographic material as in claim 1, wherein $R_{13}$, $R_{14}$, $R_{17}$, and $R_{18}$ are each independently selected from the group consisting of a hydrogen atom, an alkyl group, an aryl group, an alkoxy group, an aryloxy group, an alkylthio group, a ureido group, an oxycarbonylamino group, and an acylamino group; and $R_{15}$ and $R_{16}$ are each independently selected from the group consisting of a hydrogen atom, a halogen atom, an alkyl group, an aryl group, and an alkoxy group.

13. The silver halide color photographic material as in claim 1, wherein $R_{19}$ is selected from the group consisting of an alkyl group, an aryl group, a heterocyclic group, an alkoxy group, an aryloxy group, an alkylthio group, an arylthio group, an alkoxycarbonyl group, a carbamoyl group, and an acyl group.

14. The silver halide color photographic material as in claim 13, wherein $R_{19}$ represents an alkyl group, an aryl group, a heterocyclic group, an alkylthio group or an arylthio group.

15. The silver halide color photographic material as in claim 1, wherein n in formula (III) is 0 or 2.

16. The silver halide color photographic material as in claim 1, wherein Z represents —S—, —SO—, —$SO_2$— or —O—.

17. The silver halide color photographic material as in claim 1, wherein said compound represented by formula (I), (II), or (III) is used in combination with a cyan coupler, a magenta coupler or a yellow coupler in the same layer, wherein said couplers are capable of being coupled with the oxidation product of a primary aromatic amine color developing agent to form cyan color, magenta color and yellow color, respectively.

18. The silver halide color photographic material as in claim 1, further comprising a coupler, in the same layer as said compound of formulas (I), (II) or (III), wherein said compound of formulas (I), (II) or (III) is present in an amount of 0.5 to 300 mol %, based on the amount of said coupler used in said same layer.

19. The silver halide color photographic material as in claim 1, wherein n is 0.

* * * * *